US008012660B2

(12) United States Patent
Yamashita et al.

(10) Patent No.: US 8,012,660 B2
(45) Date of Patent: Sep. 6, 2011

(54) IMAGE FORMING METHOD AND IMAGE FORMING APPARATUS

(75) Inventors: Hiroshi Yamashita, Numazu (JP); Takashi Fujita, Yokohama (JP); Kazumi Suzuki, Sunto-gun (JP); Tsuyoshi Sugimoto, Mishima (JP)

(73) Assignee: Ricoh Co., Ltd., Tokyo (JP)

( * ) Notice: Subject to any disclaimer, the term of this patent is extended or adjusted under 35 U.S.C. 154(b) by 759 days.

(21) Appl. No.: 11/857,999

(22) Filed: Sep. 19, 2007

(65) Prior Publication Data

US 2008/0069606 A1 Mar. 20, 2008

(30) Foreign Application Priority Data

Sep. 19, 2006 (JP) ..... 2006-252544

(51) Int. Cl.
*G03G 15/16* (2006.01)

(52) U.S. Cl. ..... 430/124.1

(58) Field of Classification Search ..... 430/124.1
See application file for complete search history.

(56) References Cited

U.S. PATENT DOCUMENTS

| | | | |
|---|---|---|---|
| 6,660,443 | B2 | 12/2003 | Sugiyama et al. |
| 6,740,460 | B2 | 5/2004 | Tomita et al. |
| 6,756,175 | B2 | 6/2004 | Emoto et al. |
| 6,787,280 | B2 | 9/2004 | Yamashita et al. |
| 6,800,412 | B2 | 10/2004 | Sugiyama et al. |
| 6,824,945 | B2 | 11/2004 | Emoto et al. |
| 6,835,519 | B2 | 12/2004 | Sugiyama et al. |
| 6,846,604 | B2 | 1/2005 | Emoto et al. |
| 6,849,369 | B2 | 2/2005 | Yagi et al. |
| 6,852,462 | B2 | 2/2005 | Emoto et al. |
| 6,946,229 | B2 | 9/2005 | Suzuki et al. |
| 7,005,223 | B2 | 2/2006 | Yamashita |
| 7,074,535 | B2 | 7/2006 | Saito et al. |
| 7,074,541 | B2 | 7/2006 | Yamashita et al. |
| 7,110,710 | B2 | 9/2006 | Yamashita et al. |
| 7,198,874 | B2 | 4/2007 | Saito et al. |
| 7,214,461 | B2 | 5/2007 | Yamashita et al. |
| 7,241,548 | B2 | 7/2007 | Sugiyama et al. |
| 7,711,301 | B2 * | 5/2010 | Takemoto et al. ..... 399/313 |

(Continued)

FOREIGN PATENT DOCUMENTS

JP 10-063121 3/1998

(Continued)

OTHER PUBLICATIONS

U.S. Appl. No. 10/957,629, filed Apr. 14, 2005, Watanabe, et al.

(Continued)

*Primary Examiner* — Hoa V Le

(74) *Attorney, Agent, or Firm* — Oblon, Spivak, McClelland, Maier & Neustadt, L.L.P.

(57) ABSTRACT

An image forming method is provided including: charging an image bearing member; irradiating the image bearing member with a light beam to form an electrostatic latent image thereon; developing the electrostatic latent image with a toner to form a toner image on the image bearing member; primarily transferring the toner image from the image bearing member onto an intermediate transfer member; secondarily transferring the toner image from the intermediate transfer member onto a transfer-fixing member; heating the toner image on the transfer-fixing member; and fixing the toner image on a recording medium passing through a nip formed between the transfer-fixing member and a pressing member, wherein the toner has a weight average particle diameter (D4) from 3 to 5 μm.

9 Claims, 3 Drawing Sheets

U.S. PATENT DOCUMENTS

| | | | | |
|---|---|---|---|---|
| 2003/0027066 | A1 | 2/2003 | Yamashita et al. | |
| 2003/0027070 | A1* | 2/2003 | Niwa | 430/108.22 |
| 2003/0055159 | A1 | 3/2003 | Yamashita et al. | |
| 2003/0219669 | A1 | 3/2003 | Yamashita et al. | |
| 2003/0096185 | A1 | 5/2003 | Yamashita et al. | |
| 2003/0203301 | A1* | 10/2003 | Iga | 430/108.1 |
| 2004/0110081 | A1* | 6/2004 | Tanaka et al. | 430/137.15 |
| 2004/0115551 | A1 | 6/2004 | Sugiyama et al. | |
| 2004/0131961 | A1 | 7/2004 | Watanabe et al. | |
| 2005/0079433 | A1 | 4/2005 | Watanabe et al. | |
| 2005/0164114 | A1 | 7/2005 | Yagi et al. | |
| 2005/0196691 | A1 | 9/2005 | Ohtani et al. | |
| 2006/0063081 | A1 | 3/2006 | Nagatomo et al. | |
| 2006/0068312 | A1 | 3/2006 | Yamashita et al. | |
| 2006/0088782 | A1* | 4/2006 | Lee et al. | 430/137.11 |
| 2006/0093408 | A1* | 5/2006 | Hamada et al. | 399/296 |
| 2006/0127788 | A1 | 6/2006 | Yamashita et al. | |
| 2006/0166119 | A1* | 7/2006 | Hayashi et al. | 430/109.1 |
| 2006/0172221 | A1* | 8/2006 | Kurokawa | 430/137.15 |
| 2006/0177756 | A1 | 8/2006 | Sugimoto et al. | |
| 2006/0240349 | A1 | 10/2006 | Watanabe et al. | |
| 2006/0269865 | A1* | 11/2006 | Oyama | 430/137.11 |
| 2006/0292482 | A1 | 12/2006 | Yamashita et al. | |
| 2007/0015077 | A1 | 1/2007 | Yamashita et al. | |
| 2007/0031752 | A1 | 2/2007 | Watanabe et al. | |
| 2007/0042285 | A1* | 2/2007 | Kitani et al. | 430/110.2 |
| 2007/0087281 | A1* | 4/2007 | Patel et al. | 430/110.2 |

FOREIGN PATENT DOCUMENTS

| | | |
|---|---|---|
| JP | 2004-145260 | 5/2004 |

OTHER PUBLICATIONS

U.S. Appl. No. 11/029,453, filed Sep. 8, 2005, Ohtani, et al.
U.S. Appl. No. 11/023,110, filed Jul. 28, 2005, Yagi, et al.
U.S. Appl. No. 11/206,128, filed Dec. 28, 2006, Yamashita, et al.
U.S. Appl. No. 11/227,566, filed Mar. 23, 2006, Nagatomo, et al.
U.S. Appl. No. 11/229,748, filed Mar. 30, 2006, Yamashita, et al.
U.S. Appl. No. 11/328,280, filed Jun. 15, 2006, Yamashita, et al.
U.S. Appl. No. 11/339,731, filed Aug. 10, 2006, Sugimoto, et al.
U.S. Appl. No. 11/487,374, filed Jan. 18, 2007, Yamashita, et al.
U.S. Appl. No. 11/475,165, filed Oct. 26, 2006, Watanabe, et al.
U.S. Appl. No. 11/545,429, filed Feb. 8, 2007, Watanabe, et al.
U.S. Appl. No. 11/734,895, filed Apr. 13, 2007, Yamashita, et al.
U.S. Appl. No. 11/752,343, filed May 23, 2007, Nagatomo, et al.
U.S. Appl. No. 12/209,583, filed Sep. 12, 2008, Seshita, et al.

* cited by examiner x 40K 500nm

IMAGE FORMING METHOD AND IMAGE FORMING APPARATUS

CROSS REFERENCE TO RELATED APPLICATIONS

This patent application is based on and claims priority under 35 U.S.C. §119 from Japanese Patent Application No. JP2006-252544 filed on Sep. 19, 2006 in the Japan Patent Office, the entire contents of which are incorporated herein by reference.

BACKGROUND OF THE INVENTION

1. Field of the Invention

The present invention relates to an image forming method and an image forming apparatus for use in electrophotography.

2. Discussion of the Background

An image forming method including the following steps is known in the field of image formation:

(1) forming an image on an image bearing member by a developing means;

(2) primarily transferring the image from the image bearing member onto an intermediate transfer member by a primary transfer means;

(3) secondarily transferring the image from the intermediate transfer member onto a recording medium by a secondary transfer means; and (4) fixing the image on the recording medium by a fixing means.

While an image forming method performing each image forming step in a sequential manner is used in the market, published unexamined Japanese patent application Nos. (hereinafter referred to as JP-A) 10-63121 and 2004-145260 have described image forming methods including a process in which the transfer and fixing processes are simultaneously performed. This process will be hereinafter referred to as "transfer-fixing process." In the former application, an image is transfer-fixed from an intermediate transfer member onto a recording medium. In the latter application, an image is secondarily transfer-fixed from an intermediate transfer member onto a transfer-fixing member, and then thirdly transfer-fixed from the transfer-fixing member onto a recording medium.

A toner, which is a powder constituted of a resin having a chargeability, is typically used as a material for forming an image in the above discussed image forming methods.

In the typical image forming method, the image quality tends to deteriorate when an image is transferred onto a recording medium, which may include papers. Papers may have different thicknesses (e.g., plain paper, thick paper) and different surface natures (e.g., smooth, rough). When a paper having a rough surface is used, an intermediate transfer member cannot faithfully adhere to the surface of the paper, and therefore microgaps are formed on the paper. In the microgaps, an image cannot be normally transferred due to abnormal electrical discharge. As stated above, the typical image forming method has a disadvantage that an abnormal image is easily formed in the transfer process.

On the other hand, the image forming method including the transfer-fixing process has an advantage that the image quality hardly deteriorates, even if a paper having a rough surface is used for the following reasons. In this method, a heat is applied to a toner when transferred, and thereby the toner is softened, melted, and becomes a block having viscoelasticity. The toner block having viscoelasticity can be easily transferred even in an image portion formed on the microgap. It is considered that the image forming method having the transfer-fixing process is a suitable method for producing high quality images.

It is advantageous in terms of energy to heat an image on a transfer member before fixing the image on a recording medium because applying heat only to the image on the transfer member reduces the heat absorbed by the recording medium.

Although the above method has some advantages, the following problems still exist.

(I) When an image having dots is transfer-fixed, latent images of the dots need to be accurately developed. If the dots are developed with a toner having poor dot reproducibility, toner particles tend to be scattered. These scattered toner particles tend not to be transfer-fixed.

(II) When an image on a transfer member is heated, a toner tends to melt and liquefy. Thereby, each of the uniformly formed dots tends to expand, contract, or transform, resulting in poor reproducibility of the latent image. As a result, an image with low image density, blurred, and somber features tends to be formed on the recording medium.

SUMMARY OF THE INVENTION

Accordingly, an object of the present invention is to provide an image forming method and apparatus in which dots are uniformly reproduced and the image quality hardly deteriorates in the transfer-fixing process.

Another object of the present invention is to provide an image forming method and apparatus in which dots formed on a transfer member hardly transform from a desired shape even if heat is applied to the transfer member.

These and other objects of the present invention, either individually or in combinations thereof, as hereinafter will become more readily apparent and attained by an image forming method including steps of charging an image bearing member;

irradiating the image bearing member with a light beam to form an electrostatic latent image thereon;

developing the electrostatic latent image with a toner to form a toner image on the image bearing member;

primary-transferring the toner image from the image bearing member onto an intermediate transfer member;

secondary-transferring the toner image from the intermediate transfer member onto a transfer-fixing member;

heating the toner image on the transfer-fixing member; and fixing the toner image on a recording medium passing through a nip formed between the transfer-fixing member and a pressing member.

The toner has a weight average particle diameter (D4) from 3 to 5 μm. The present invention also includes an image forming apparatus for performing the above method.

BRIEF DESCRIPTION OF THE DRAWINGS

These and other objects, features, and advantages of the present invention will become apparent upon consideration of the following description of the preferred embodiments of the present invention taken in conjunction with the accompanying drawings, wherein.

DETAILED DESCRIPTION OF THE INVENTION

As a result of the research of the present inventors, the following factors have been observed.

By using a spherical toner having a smaller particle diameter than conventional toners, the problem (I) mentioned above can be solved. If the toner has a further narrow particle diameter distribution, dots are uniformly reproduced and the image quality hardly deteriorates in the transfer-fixing process.

By using the toner having a resin layer, a glass transition temperature (Tg) is higher than that of a binder resin composing the toner, on the surface thereof, which solves the problem (II) mentioned above. Dots formed by such a toner on a transfer member hardly transforms from a desired shape even if heat is applied to the transfer member because each of the toner particles hardly melts, fuses, or moves. Therefore the dots hardly expand, contract, or transform.

In one example, the resin layer may be composed of a particulate resin. The present inventors have found out the optimum amount of the resin layer (which is described later).

According to one embodiment of the present invention, a toner can be preferably obtained by emulsifying or dispersing a solution or dispersion of toner constituents (such as a colorant and a binder resin) in an aqueous medium containing a particulate resin having a glass transition temperature (Tg) higher than that of the binder resin, to prepare an emulsion containing droplets to the surface of which the particulate resin is adhered.

Figure 3A:
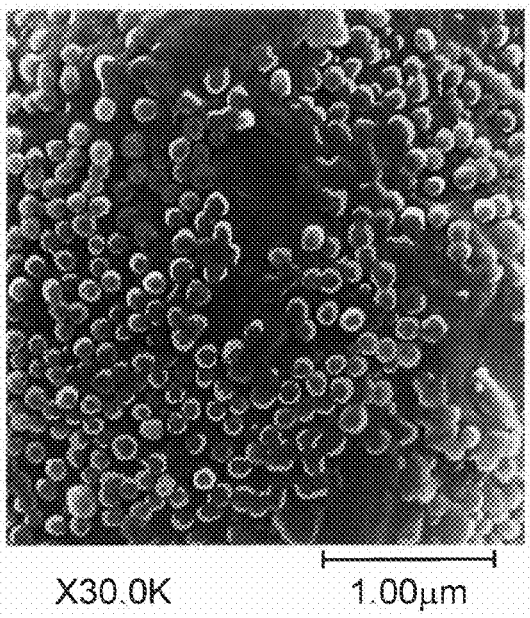
FIG. 3A is a surface image (×30,000, ×10,000) of a toner for use in the present invention.
Figure 3B:
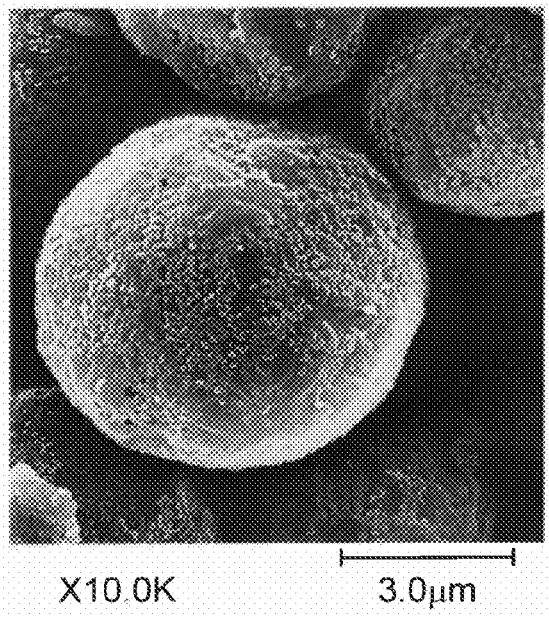
FIG. 3B is an enlarged view of a toner particle.

The particulate resin preferably has a cross-linking structure because such a particulate resin does not dissolve and adheres to the surfaces of the droplets in a form of particles, as shown in FIG. 3A. When the particulate resin adheres to the surfaces of the droplets in a form of particles, the binder resin of the toner is not prevented from fixing to a surface when melted. In addition, such a particulate resin hardly crushes due to its rigidity even if a mechanical stress is applied thereto. As a result, the resultant toner has good transferability. FIG. 3B is an enlarged view of a particular particle from FIG. 3A.

Figure 2:
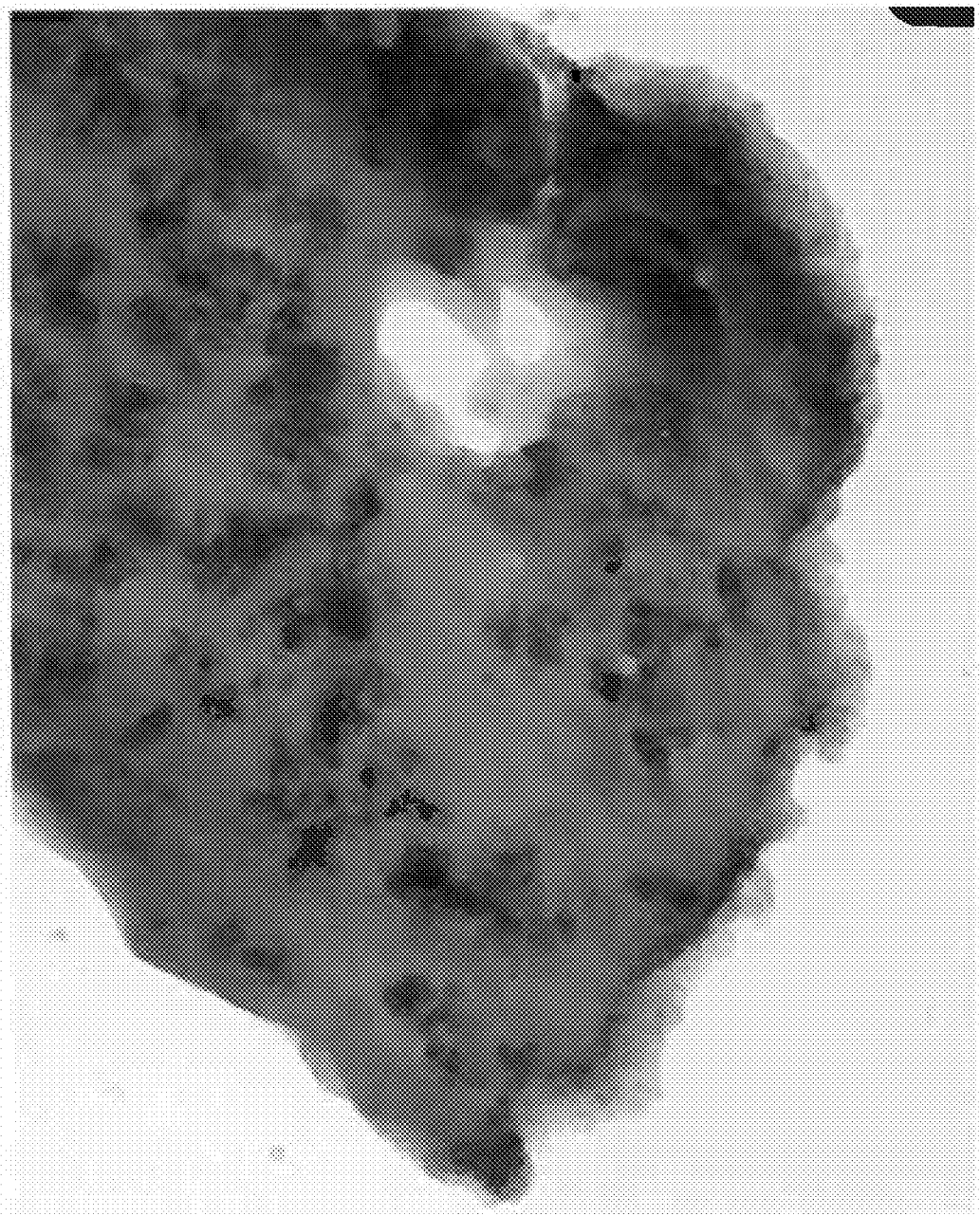
FIG. 2 is a cross-sectional image (×40,000) of a toner for use in the present invention.

FIG. 2 is a cross-sectional image of a toner particle, obtained by observing an ultra thin section of the toner particle using a transmission electron microscope (TEM). In FIG. 2, a particulate resin layer is observed on the right side of the toner particle. On the left side, a particulate resin layer peels off due to the application of a physical stress when the toner particle is cut to provide the ultrathin section. A plurality of black particles dispersed inside the toner particle are colorant particles.

Particle Diameter and Particle Diameter Distribution

Generally, a smaller particle diameter of a toner produces higher definition images because an electrostatic latent image is accurately developed. In one embodiment of the present invention, the toner preferably has a weight average particle diameter (D4) from 3 to 5 μm. D4 is defined by the following equation:

$$D4=\Sigma(nD^4)/\Sigma(nD^3),$$

where n represents the number of toner particles, and D represents the particle diameter.

When D4 is too small, primary transferability of the toner deteriorates because the adherence between the toner and a photoreceptor increases. In contrast, when D4 is too large, dot reproducibility is not satisfactory and a granularity in halftone images deteriorates, and therefore high definition images cannot be produced. When the particle diameter distribution (i.e., the ratio of the weight average particle diameter (D4) to the number average particle diameter (D1)) (D4)/(D1) is from 1.0 to 1.15, the toner has a narrow particle diameter distribution and good dot reproducibility. When (D4)/(D1) is too large, for example, too large an amount of fine particles exist and (D1) is too small. D1 is defined by the following equation:

$$D1=\Sigma(nD)/\Sigma n,$$

where n represents the number of the toner particles, and D represents the particle diameter.

Thus, a transferability of the toner deteriorates because the adherence between a photoreceptor increases. When an amount of coarse particles is too large and (D4) is too large, the dot reproducibility deteriorates.

The particle diameters of a toner can be measured using an instrument such as a COULTER MULTISIZER III (from Beckman Coulter K. K.), for example.

According to one embodiment of the present invention, a measuring method is as follows:

(1) 0.1 to 5 ml of a surfactant (preferably an alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 50 μm to determine a volume and number distribution thereof; and (4) the weight average particle diameter (D4) and the number average particle diameter (D1) is determined from the measurements of the volume and the number of toner particles.

Toner Shape

The shape of a toner largely influences the primary transferability of the toner from a photoreceptor and secondary transfer ability of the toner from an intermediate transfer member. As the shape of a toner approaches a sphere, the transferability of the toner increases, resulting in formation of high definition images without image defects.

According to one embodiment, the shape of a particle is preferably determined by an optical detection method such that an image of the particle is optically detected by a CCD camera and analyzed. A particle suspension passes through the image detector located on the flat plate to be detected.

In one example, the circularity of a particle is determined by the following equation:

$$\text{Circularity}=Cs/Cp$$

wherein Cp represents the length of the circumference of the image of a particle and Cs represents the length of the circumference of a circle having the same area as that of the image of the particle.

Using a toner having an average circularity of from 0.95 to 0.99 results in high definition images having a reproducible density.

According to one embodiment, an average circularity of a toner can be determined using a flow-type particle image analyzer FPIA-3000 (manufactured by Sysmex Corp.) to perform a measurement method as follows:

(1) 0.1 to 0.5 ml of a surfactant (preferably alkylbenzene sulfonate) is included as a dispersant in 100 to 150 ml of water from which solid impurities have been removed;

(2) 0.1 to 0.5 g of a toner is added to the electrolyte and dispersed using an ultrasonic dispersing machine for about 1 to 3 minutes to prepare a toner suspension liquid including 3,000 to 10,000 per 1 micro-liter of the toner particles; and (3) the average circularity and circularity distribution of the toner are determined by the measuring instrument mentioned above.

Particulate Resin

Any desired resins capable of forming an aqueous dispersion thereof can be used for the particulate resin for use in the present invention. For example, both thermoplastic resins and thermosetting resins can be used. Specific examples of the resins for use in the particulate resin include, but are not limited to, vinyl resins, polyurethane resins, epoxy resins, polyester resins, polyamide resins, polyimide resins, silicon resins, phenol resins, melamine resins, urea resins, aniline resins, ionomer resins, and polycarbonate resins. As an example, these resins can be used alone or in combination. According to one embodiment, these resins, vinyl resins, polyurethane resins, epoxy resins, polyester resins, and mixtures thereof are preferably used because these resins can easily form an aqueous dispersion of fine particles thereof.

The particulate resin preferably has a higher glass transition temperature (Tg) than the binder resin of the toner. In one embodiment, the glass transition temperature of the particulate resin can be varied by changing a monomer composition as appropriate.

The glass transition temperature can be measured using a DSC system DSC-60 (from Shimadzu Corporation) to perform the following exemplary method:

(1) about 10 mg of a sample is contained in an aluminum container, and then the container is put on a holder unit in an electric furnace;

(2) the sample is heated from room temperature to 150° C. at a temperature rising rate of 10° C./min, and left for 10 minutes at 150° C.;

(3) the sample is cooled to room temperature and left for 10 minutes; and (4) the sample is heated again from room temperature to 150° C. at a temperature rising rate of 10° C./min under nitrogen atmosphere.

According to one embodiment, the Tg is determined using an analysis system DSC-60 by finding a contact point of the tangent line of the endothermic curve close to the Tg and the baseline. The vinyl resin can be formed by a homopolymerization of a vinyl monomer or a copolymerization of vinyl monomers.

Specific examples of the vinyl monomers are described below.

(1) Vinyl hydrocarbons:

(1-1) Aliphatic vinyl hydrocarbons: alkenes (e.g., ethylene, propylene, butene, isobutylene, pentene, heptene, diisobutylene, octene, dodecene, octadecene, other α-olefins except the above-mentioned compounds) and alkadienes (e.g., butadiene, isoprene, 1,4-pentadiene, 1,6-hexadiene, 1,7-octadiene);

(1-2) Alicyclic vinyl hydrocarbons: mono- or di-cycloalkenes and cycloalkadienes (e.g., cyclohexene, (di) cyclopentadiene, vinylcyclohexene, ethylidenebicycloheptene), and terpenes (e.g., pinene, limonene, indene); and (1-3) Aromatic vinyl hydrocarbons: styrene and hydrocarbon (alkyl, cycloalkyl, aralkyl and/or alkenyl) derivatives thereof (e.g., α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene), and vinylnaphthalene;

(2) Vinyl monomers including a carboxyl group and salts thereof:

unsaturated monocarboxylic or dicarboxylic acids having 3 to 30 carbon atoms and anhydrides and monoalkyl (1 to 24 carbon atoms) esters thereof (e.g., (meth)acrylic acid, maleic acid, maleic anhydride, monoalkyl maleate, fumaric acid, monoalkyl fumarate, crotonic acid, itaconic acid, monoalkyl itaconate, itaconic glycol monoether, citraconic acid, monoalkyl citraconate, cinnamic acid), and salts thereof;

(3) Vinyl monomers including a sulfonic group and vinyl monoesters of sulfuric acid, and salts thereof:

alkene sulfonic acids having 2 to 14 carbon atoms (e.g., vinyl sulfonic acid, (meth)allyl sulfonic acid, methyl vinyl sulfonic acid, styrenesulfonic acid) and alkyl derivatives thereof having 2 to 24 carbon atoms (e.g., α-methylstyrene sulfonic acid); sulfo(hydroxy)alkyl (meth)acrylates or (meth)acrylamides (e.g., sulfopropyl (meth)acrylate, 2-hydroxy-3-(meth) acryloxypropyl sulfonic acid, 2-(meth)acryloylamino-2,2-dimethylethane sulfonic acid, 2-(meth)acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, alkyl (3 to 18 carbon atoms)allylsulfo succinic acid, sulfuric acid ester of poly(n is 2 to 30)oxyalkylene (ethylene, propylene, butylene and mono, random and block copolymers thereof) mono(meth)acrylate such as sulfuric acid ester of poly (n is 5 to 15)oxypropylene monomethacrylate, sulfuric acid esters of polyoxyethylene polycyclic phenyl ether), and salts thereof. The following exemplary compounds (3-1) to (3-2):

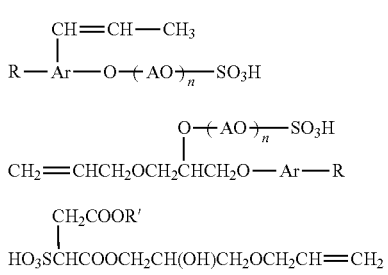

(3-1)

(3-2)

(3-3)

wherein R represents an alkyl group having 1 to 15 carbon atoms, A represents an alkylene group having 2 to 4 carbon atoms, Ar represents a benzene ring, R' represents an alkyl group having 1 to 15 carbon atoms which can be substituted with a fluorine atom, and n represents an integer from 1 to 50. When n is 2 or more, plural A may be same or different;

(4) vinyl monomers including a phosphate group and salts thereof:

(meth)acryloyloxyalkyl (1 to 24 carbon atoms) phosphoric acid monoesters (e.g., 2-hydroxyethyl(meth)acryloyl phosphate, phenyl-2-acryloyloxyethyl phosphate);

(meth)acryloyloxyalkyl (1 to 24 carbon atoms) phosphonic acids (e.g., 2-acryloyloxyethyl phosphonic acid); and salts thereof.

Specific examples of the above-mentioned salts of monomers shown in the above paragraphs (2) to (4) include alkali metal salts (e.g., sodium salts, potassium salts), alkaline-earth metal salts (e.g., calcium salts, magnesium salts), ammonium salts, amine salts, and quaternary ammonium salts;

(5) Vinyl monomers including hydroxyl group:

hydroxystyrene, N-methylol (meth)acrylamide, hydroxyethyl (meth)acrylate, hydroxypropyl (meth)acrylate, polyethyleneglycol mono(meth)acrylate, (meth)allylalcohol, crotyl alcohol, isocrotyl alcohol, 1-butene-3-ol, 2-butene-1-ol, 2-butene-1,4-diol, propargyl alcohol, 2-hydroxyethyl propenyl ether, and sucrose allyl ether;

(6) Vinyl monomers including nitrogen:

(6-1) Vinyl monomers including amino group: aminoethyl (meth)acrylate, dimethylaminoethyl (meth)acrylate, diethylaminoethyl (meth)acrylate, t-butylaminoethyl (meth)acrylate, N-aminoethyl(meth)acrylamide, (meth)acrylamine, morpholinoethyl (meth)acrylate, 4-vinylpyridine, 2-vinylpyridine, crotylamine, N,N-dimethylaminostyrene, methyl-α-acetoamino acrylate, vinylimidazole, N-vinylpyrrol, N-vinylthiopyrrolidone, N-arylphenylenediamine, aminocarbazole, aminothiazole, aminoindole, aminopyrrol, aminoimidazole, aminomercaptothiazole, and salts thereof;

(6-2) Vinyl monomers including amide group: (meth)acrylamide, N-methyl(meth)acrylamide, N-butylacrylamide, diacetoneacrylamide, N-methylol(meth)acrylamide, N,N-methylene-bis(meth)acrylamide, cinammic acid amide, N,N-dimethylacrylamide, N,N-dibenzylacrylamide, methacrylformamide, N-methyl-N-vinylacetamide, and N-vinylpyrrolidone;

(6-3) Vinyl monomers including a nitrile group: (meth)acrylonitrile, cyanostyrene, and cyanoacrylate;

(6-4) Vinyl monomers including quaternary ammonium cation group: quaternary compounds of vinyl monomers (e.g., dimethylaminoethyl(meth)acrylate, diethylaminoethyl (meth)acrylate, dimethylaminoethyl (meth)acrylamide, diethylaminoethyl (meth)acrylamide, diallylamine) including tertiary amine group produced by using quaternate agent (e.g., methyl chloride, dimethyl sulfonic acid, and benzyl chloride, dimethyl carbonate); and (6-5) Vinyl monomers including a nitro group: nitrostyrene;

(7) Vinyl monomers including an epoxy group: glycidyl (meth)acrylate, tetrahydrofurfuryl (meth)acrylate, p-vinylphenylphenyloxide;

(8) Vinyl monomers including a halogen atom: vinyl chloride, vinyl bromide, vinylidene chloride, allyl chloride, chlorostyrene, bromostyrene, dichlorostyrene, chloromethylstyrene, tetrafluorostyrene, chloroprene;

(9) Vinylesters, vinyl(thio)ethers, vinylketones, and vinylsulfones:

(9-1) Vinylesters: vinyl acetate, vinyl butyrate, vinyl propionate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinylmethoxy acetate, vinyl benzoate, ethyl-α-ethoxy acrylate, alkyl (meth)acrylates including an alkyl group having 1 to 50 carbon atoms (such as methyl (meth)acrylate, ethyl (meth)acrylate, propyl (meth)acrylate, butyl (meth)acrylate, 2-ethylhexyl (meth)acrylate, dodecyl (meth)acrylate, hexadecyl (meth)acrylate, heptadecyl (meth)acrylate, and eicocyl (meth)acrylate), dialkyl fumarates (2 alkyl groups have 2 to 8 carbon atoms and have straight-chain, branched-chain or alicyclic structure), dialkyl maleates (2 alkyl groups have 2 to 8 carbon atoms and have straight-chain, branched-chain or alicyclic structure), poly(meth)allyloxyalkanes (such as diallyloxyethane, triallyloxyethane, tetraallyloxyethane, tetraallyloxypropane, tetraallyloxybutane, and tetramethallyloxyethane), vinyl monomers including polyalkyleneglycol chain (such as polyethyleneglycol (molecular weight of 300) mono(meth)acrylate, polypropyleneglycol (molecular weight of 500) monoacrylate, adduct of methyl alcohol (meth)acrylate with 10 mols of ethyleneoxide, and adduct of lauryl alcohol (meth)acrylate with 30 mols of ethyleneoxide), and poly(meth)acrylates ((meth)acrylates of polyalcohols such as ethyleneglycol di(meth)acrylate, propyleneglycol di(meth)acrylate, neopentylglycol di(meth)acrylate, trimethylolpropane tri(meth)acrylate, and polyethyleneglycol di(meth)acrylate);

(9-2) Vinyl(thio)ethers: vinylmethylether, vinylethylether, vinylpropylether, vinylbutylether, vinyl-2-ethylhexylether, vinylphenylether, vinyl-2-methoxyethylether, methoxybutadiene, vinyl-2-butoxyethylether, 3,4-dihydro-1,2-pyran, 2-butoxy-2'-vinyloxydiethylether, vinyl-2-ethylmercaptoethylether, acetoxystyrene, phenoxystyrene; and (9-3) Vinylketones (e.g., vinyl methyl ketone, vinyl ethyl ketone, vinyl phenyl ketone), and vinylsulfones (e.g., divinylsulfide, p-vinyldiphenylsulfide, vinylethylsulfide, vinylethylsulufone, divinylsulfone, divinylsulfoxide);

(10) Other exemplary vinyl monomers: isocyanatoethyl (meth)acrylate, and m-isopropenyl-α,α-dimethylbenzylisocyanate.

Specific examples of the vinyl copolymer resins include copolymers of two or more vinyl monomers shown in the above paragraphs (1) to (10) at any desired mixing ratio such as styrene-(meth)acrylate copolymer, styrene-butadiene copolymer, (meth)acrylic acid-acrylate copolymer, styrene-acrylonitrile copolymer, styrene-maleic anhydride copolymer, styrene-(meth)acrylic acid copolymer, styrene-(meth) acrylic acid-divinylbenzene copolymer, and styrene-styrene sulfonic acid-(meth)acrylate copolymer.

A cross-linked resin can be obtained by a copolymerization using a monomer having plural vinyl groups per molecule. Specific examples of such monomers include, but are not limited to, divinylbenzene and ethylene glycol dimethacrylate.

A resin for preparing the above-mentioned particulate resin has to be capable of forming an aqueous dispersion of fine particles thereof. The resin has to be in soluble in water under the conditions in which the toner particle dispersion is formed. For this reason, when the vinyl resin is a copolymer resin formed by a hydrophobic monomer and a hydrophilic monomer, the vinyl resin preferably includes the hydrophobic monomer in an amount of not less than 10% by weight, and more preferably not less than 30% by weight. When the amount of the hydrophobic resin is too small, the vinyl resin tends to be dissolved in water, and the resultant toner has a wide particle diameter distribution.

As an example, the hydrophilic monomer is defined as a monomer which is to be dissolved in water. In contrast, the hydrophobic monomer is defined as another monomer except for the hydrophilic monomer (i.e., a monomer which are incompatible with water).

According to exemplary embodiments of the present invention, methods for forming an aqueous dispersion of a particulate resin are as follows.

(1) When the resin is a vinyl resin, an aqueous dispersion of a particulate resin is directly formed by a polymerization reaction (such as suspension polymerization, emulsion polymerization, seed polymerization, and dispersion polymerization) of monomers in an aqueous medium.

(2) When the resin is a polyaddition resin or a polycondensation resin such as polyester resin, polyurethane resin, and epoxy resin, a precursor of the resin (such as monomer and oligomer), or a solvent solution of the precursor is dispersed in an aqueous medium in the presence of a suitable dispersing agent, followed by heating or adding a curing agent so that an aqueous dispersion of a particulate resin is formed.

(3) When the resin is a polyaddition resin or a polycondensation resin such as polyester resin, polyurethane resin, and epoxy resin, a precursor of the resin (such as monomer and oligomer), or a solvent solution (preferably in liquid form, if not liquid, preferably liquefy by the application of heat) of the precursor is phase-inversion emulsified by adding an aqueous medium after adding a suitable emulsifying agent thereto so that an aqueous dispersion of a particulate resin is formed.

(4) A resin formed by a polymerization reaction (such as addition polymerization, ring-opening polymerization, condensation polymerization, addition condensation, etc.) is pulverized using a mechanical rotational type pulverizer or a jet type pulverizer, followed by classification, to prepare a particulate resin. The particulate resin is dispersed in an aqueous medium in the presence of a suitable dispersing agent SO that an aqueous dispersion of the particulate resin is formed.

(5) A resin formed by a polymerization reaction (such as addition polymerization, ring-opening polymerization, condensation polymerization, addition condensation, etc.) is dissolved in a solvent, and then the resin solution is sprayed in the air to prepare a particulate resin. The particulate resin is dispersed in an aqueous medium in the presence of a suitable dispersing agent so that an aqueous dispersion of the particulate resin is formed.

(6) A resin formed by a polymerization reaction (such as addition polymerization, ring-opening polymerization, condensation polymerization, addition condensation, etc.) is dissolved in a solvent to prepare a resin solution. Another solvent is added to the resin solution or the resin solution is subjected to cooling after heating. The solvent is subsequently removed so that a particulate resin separates from the resin solution. The particulate resin is dispersed in an aqueous medium in the presence of a suitable dispersing agent so that an aqueous dispersion of the particulate resin is formed.

(7) A resin formed by a polymerization reaction (such as addition polymerization, ring-opening polymerization, condensation polymerization, addition condensation, etc.) is dissolved in a solvent, and then the resin solution is dispersed in an aqueous medium in the presence of a suitable dispersing agent, followed by removal of the solvent, so that an aqueous dispersion of a particulate resin is formed.

(8) A resin formed by polymerization reaction (such as addition polymerization, ring-opening polymerization, condensation polymerization, addition condensation, etc.) is dissolved in a solvent, and then the resin solution is phase-inversion emulsified by adding an aqueous medium after adding a suitable emulsifying agent thereto so that an aqueous dispersion of a particulate resin is formed.

The particle diameter of the particulate resin is typically smaller than that of the toner. In order to obtain a toner having a narrow particle diameter distribution, the particle diameter ratio of a particulate resin to a toner (i.e., the volume average particle diameter of a particulate resin/the volume average particle diameter of a toner) is preferably from 0.001 to 0.3. When the ratio is too large, the particulate resin cannot effectively adsorb (i.e., adhere) to the surface of the toner. Therefore, the particle diameter distribution of the toner tends to widen.

In one embodiment, the volume average particle diameter of the particulate resin can be controlled so that the resultant toner has a targeted particle diameter, unless the particle diameter ratio is within the above disclosed range. For example, to obtain a toner having a volume average particle diameter of 5 μm, the particulate resin preferably has a volume average particle diameter from 0.0025 to 1.5 μm, and more preferably from 0.005 to 1.0 μm. To obtain a toner having a volume average particle diameter of 10 μm, the particulate resin preferably has a volume average particle diameter of from 0.005 to 3 μm, and more preferably from 0.05 to 2 μm. As an example, the volume average particle diameter is measured using an instrument PARTICLE SIZE DISTRIBUTION ANALYZER LA-920 (from Horiba, Ltd.).

Toner Components (Resin)

Specific exemplary examples of the resin used for the toner for use in embodiments of the present invention include, but are not limited to: polyester; homopolymers of styrene and derivatives thereof (e.g., polystyrene, poly p-chlorostyrene, polyvinyl toluene); and styrene copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer).

As an example, one or more of the following resins can be mixed with the above resins: polymethyl methacrylate, polybutyl methacrylate, polyvinyl chloride, polyvinyl acetate, polyethylene, polypropylene, polyurethane, polyamide, epoxy resin, polyvinyl butyral, polyacrylic acid resin, rosin, modified rosin, terpene resin, phenol resin, aliphatic or alicyclic hydrocarbon resin, aromatic petroleum resin, chlorinated paraffin, paraffin wax, etc.

Among these resins, in one embodiment polyester resins are used because of having desired fixability to a surface. A polyester resin is formed from a condensation polymerization between an alcohol and a carboxylic acid.

Specific exemplary examples of the alcohols for preparing a polyester resin include, but are not limited to: diols (e.g., polyethylene glycol, diethylene glycol, triethylene glycol, 1,2-propylene glycol, 1,3-propylene glycol, 1,4-butanediol, neopentyl glycol, 1,4-butenediol), 1,4-bis (hydroxymethyl) cyclohexane, bisphenol A, hydrogenated bisphenol A, etherified bisphenol A (e.g., polyoxyethylenated bisphenol A, polyoxypropylenated bisphenol A), these above-mentioned divalent alcohols substituted with a saturated or unsaturated hydrocarbon group having 3 to 22 carbon atoms, and other desired divalent alcohols.

Specific exemplary examples of the carboxylic acids for preparing a polyester resin include, but are not limited to: maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, these aforementioned divalent organic acids substituted with a saturated or unsaturated hydrocarbon group having 3 to 22 carbonatoms, dimers of an acid anhydride or a lower alkyl ester thereof and linolenic acid, and other desired divalent organic acids.

As an example, not only the above difunctional monomers, but also polyfunctional monomers having 3 or more functional groups are also used for preparing a polyester resin used for a binder resin.

Specific exemplary examples of polyol monomers having 3 or more valences include, but are not limited to: sorbitol, 1,2,3,6-hexanetetrol, 1,4-sorbitane, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of polycarboxylic acid monomers having 3 or more valences include, but are not limited to: 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, and acid anhydrides thereof.

(Other Components)

In another embodiment, the toner may optionally include a colorant, a release agent, a charge controlling agent, a particulate inorganic material, a fluidizer, a cleanability improving agent, a magnetic material, a metal soap, etc., or any of the desired material.

(Colorant)

Specific examples of the colorants for use in the present invention include, but are not limited to: any desired dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmiumred, cadmiummercuryred, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone and similar lithopone materials.

According to one embodiment, the aforementioned materials are used alone or in combination with each other. As an example, the toner includes the colorant in an amount from 1 to 15% by weight. In another embodiment, the colorant is in an amount from 3 to 10% by weight.

When the amount is too small, the coloring power of the toner deteriorates. When the amount is too large, the colorant cannot be well dispersed in the toner, resulting in deterioration of coloring power and electrical properties of the toner.

In one embodiment, the colorant can be combined with a resin to be used as a master batch. Specific examples of the resin for use in the master batch pigment or for use in combination with master batch pigment include, but are not limited to, styrene polymers and substituted styrene polymers; styrene copolymers; and other resins such as polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. In one embodiment, these resins are used alone or in combination.

Specific examples of the styrene polymers and substituted styrene polymers include, but are not limited to, polyester resin, polystyrene, poly p-chlorostyrene, and polyvinyl toluene. Specific examples of the styrene copolymers include, but are not limited to, styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, and styrene-maleate copolymer.

According to one embodiment of the present invention, the master batches can be prepared by mixing one or more of the resins as mentioned above and one or more of the colorants as mentioned above and kneading the mixture while applying a high shearing force thereto. In this embodiment, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase). The organic solvent (and water, if desired) is subsequently removed resulting in a wet cake that can be used as is without being dried. When performing the mixing and kneading process, dispersing devices capable of applying a high shearing force such as three roll mills can be preferably used.

(Release Agent)

According to one embodiment, the toner may include a release agent. The release agent, as an example, has a low melting point from 50 to 120° C. Since a release agent having a low melting point is easily separated from the binder resin, such a release agent effectively functions at an interface between a fixing roller and the toner. The resultant toner has a desired hot offset resistance even if used for an oil less fixing system (i.e., no oil is applied to a fixing roller).

In one embodiment, waxes are used as the release agent.

Specific exemplary examples of the waxes include, but are not limited to: natural waxes such as plant waxes (e.g., carnauba wax, cotton wax, haze wax, rice wax), animal waxes (e.g., bees wax, lanoline), mineral waxes (e.g., ozokerite, ceresin), and petroleum waxes (e.g., paraffin, microcrystalline, petrolatum); synthetic hydrocarbon waxes such as Fischer-Tropsch wax and polyethylene wax; synthetic waxes such as esters, ketones, and ethers; fatty acid amides such as 12-hydroxystearicacidamide, stearicamide, phthalicanhydride imide, halogenated hydrocarbon; crystalline polymers having a low molecular weight such as homopolymers or copolymers of polyacrylates such as poly-n-stearyl methacrylate and poly-n-lauryl methacrylate (e.g., copolymer of n-stearyl acrylate and ethyl methacrylate); and crystalline polymers having a side-chain long alkyl group.

As one example, the aforementioned waxes can be used alone or in combination with each other.

In one embodiment, the wax has a melting point from 50 to 120° C., and more preferably from 60 to 90° C.

When the melting point is too low, thermostable preservability of the toner deteriorates. When the melting point is too high, the toner tends to cause a cold offset when the toner is fixed at low temperatures.

In one embodiment, the wax has a viscosity from 5 to 1000 cps, and more preferably from 10 to 100 cps, at a temperature of 20° C. higher than the melting point thereof.

When the viscosity is too low, releasability of the toner deteriorates. When the viscosity is too high, hot offset resistance and low temperature fixability of the toner deteriorates.

In one embodiment, the toner preferably includes a wax in an amount of from 0 to 40% by weight, and more preferably from 3 to 30% by weight. When the amount is too large, fluidity of the toner deteriorates.

(Charge Controlling Agent)

In another embodiment, the toner may optionally include a charge controlling agent. Specific exemplary examples of the charge controlling agent include, but are not limited to: any desired charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. As an example, the aforementioned agents can be used alone or in combination.

Specific examples of the commercially available products of the charge controlling agents include, but are not limited to: BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

In one embodiment, the content of the charge controlling agent is determined depending on the species of the binder resin used, whether or not an additive is added and toner manufacturing method (such as dispersion method) used. The content of the charge controlling agent is not limited to any particular manufacturing method. However, the content of the charge controlling agent is typically from 0.1 to 10 parts by weight, and preferably from 0.2 to 5 parts by weight, based on the binder resin included in the toner.

When the content is too small, charge control ability of the toner deteriorates. When the content is too high, the toner has too large a charge quantity, and thereby the electrostatic force of a developing roller attracting the toner increases, resulting in deterioration of the fluidity of the toner and image density of the toner images.

(Particulate Inorganic Material)

According to one embodiment, particulate inorganic materials can be used as an external additive adding fluidity, developability, chargeability, etc. to the toner.

Specific exemplary examples of the particulate inorganic materials include, but are not limited to: silica, alumina, titanium oxide, barium titanate, magnesium titanate, calcium titanate, strontiumtitanate, zincoxide, tinoxide, quartz sand, clay, mica, sand-lime, diatomearth, chromiumoxide, ceriumoxide, red iron oxide, antimony trioxide, magnesium oxide, zirconium oxide, barium sulfate, barium carbonate, calcium carbonate, silicon carbide, and silicon nitride. As an example, the aforementioned inorganic materials are can be used alone or in combination with each other.

In one embodiment, the particulate inorganic material preferably has a primary particle diameter of from 5 nm to 2 μm, and more preferably from 5 nm to 500 nm. The particulate inorganic material preferably has a specific surface area of from 20 to 500 $m^2/g$ when measured by a BET method.

According to the BET method, the specific surface area ($m^2/g$) can be measured using a measuring instrument such as MACSORB® model 1201 (manufactured by Mountech Co., Ltd.), by a single point method using a liquid nitrogen. First, half of a cell (which is well washed and dried) is filled with a sample, and then a weight A (g) of the sample is measured. Next, the cell is set in a measuring instrument, and dried and deaerated under dried nitrogen flow at 50° C. for more than 1 hour. The cell is then cooled to room temperature, and a measurement gas(first grade 30% $N_2$—He, flowrate: 25 ml/min) is flowed therein while charging liquid nitrogen.

An adsorbed volume V ($cm^3$) of the gas is measured, and then a surface area S ($m^2$) is calculated from the following equation:

$$S=K\cdot(1-P/P_0)\cdot V,$$

where S represents a surface area S ($m^2$), K represents the gas constant 4.29, $P/P_0$ represents a relative pressure of the adsorbed gas (i.e., 0.97), and V represents the adsorbed volume ($cm^3$) of the gas.

Accordingly, the specific surface area ($m^2/g$) is obtained by dividing the surface area S ($m^2$) by the sample weight A (g).

In one embodiment, the content of the particulate inorganic material is preferably from 0.01 to 5.0% by weight, and more preferably from 0.01 to 2.0% by weight, based on the total weight of the toner.

According to one embodiment of the present invention, the external additive used for the toner is subjected to a hydrophobizing treatment to prevent deterioration of the fluidity and charge properties of the resultant toner particularly under high humidity conditions.

Suitable hydrophobizing agents for use in the hydrophobizing treatment include, but are not limited to, silane coupling agents, silylation agents, silane coupling agents having a fluorinated alkyl group, organic titanate coupling agents, aluminum coupling agents, silicone oils, and modified silicone oils. In one embodiment, silica and titanium oxide are preferably subjected to a hydrophobizing treatment, and used as a hydrophobized silica and hydrophobized titanium oxide.

(Cleanability Improving Agent)

According to one embodiment of the present invention, the toner includes a cleanability improving agent which adds good cleaning properties to the toner such that the toner remaining on the surface of a photoreceptor or a primary transfer member even after a toner image is transferred can be easily removed.

Specific exemplary examples of such a cleanability improving agents include, but are not limited to: metal salts of fatty acids such as zinc stearate, and calcium stearate; and particulate polymers such as polymethyl methacrylate and polystyrene, which are manufactured by a method such as soap-free emulsion polymerization methods. In one embodiment, particulate resins having a relatively narrow particle diameter distribution and a volume average particle diameter of from 0.01 μm to 1 μm are preferably used as the cleanability improving agent.

(Magnetic Material)

In one embodiment, the toner may include a magnetic material. Specific exemplary examples of the magnetic materials include, but are not limited to: iron powder, magnetite, and ferrite. As an example, in view of the color tone, white-colored materials are preferably used.

Toner Manufacturing Method

The toner for use in the present invention can be prepared by any method such as a suspension polymerization method, an emulsion aggregation method, and a dissolution suspension method. For example, in one embodiment, the toner can be prepared by emulsifying or dispersing a toner constituent solution or dispersion in an aqueous medium to prepare toner particles.

According to one embodiment of the present invention, the toner is prepared by a method including:

emulsifying or dispersing a toner constituent solution or dispersion, including a compound having an active hydrogen group and a polymer capable of reacting with the active hydrogen group in an aqueous medium, to prepare resin particles (i.e., mother toner particles) comprising an adhesive base material obtained by subjecting the compound and the polymer to a reaction.

The toner is preferably prepared at a temperature from 10 to 100° C., and more preferably from 20 to 60° C.

(Toner Constituent Solution or Dispersion)

In one embodiment, the toner constituent solution or dispersion is prepared by dissolving or dispersing toner constituents in an organic solvent.

Any desired toner constituents can be used, and are not limited to any particular constituent. For example, in one embodiment, the toner constituent solution or dispersion includes at least any one of a compound having an active hydrogen group and a polymer (i.e., prepolymer) capable of reacting with the active hydrogen, and optionally includes an unmodified polyester resin, a release agent, a colorant, a charge controlling agent, etc.

In one embodiment, the organic solvent is removed from the toner constituent solution or dispersion while or after toner particles are granulated.

Any desired organic solvents which can dissolve and/or disperse toner constituents can be used, and are not limited to any particular solvent. As an example, volatile organic solvent shaving a boiling point of less than 150° C. are used because such solvents can be easily removed. Specific examples of the organic solvents include, but are not limited to: toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among these solvents, ester solvents are preferably used, and ethyl acetate is most preferably used. As an example, these organic solvents can be used alone or in combination with each other.

In one embodiment, the toner constituent solution or dispersion typically includes an organic solvent in an amount of from 40 to 300 parts by weight, preferably from 60 to 140 parts by weight, and more preferably from 80 to 120 parts by weight, based on 100 parts by weight of the toner constituents.

In one embodiment, the toner constituent solution or dispersion can be prepared by dissolving or dispersing toner constituents such as a compound having an active hydrogen group, a polymer (i.e., prepolymer) capable of reacting with the active hydrogen group, an unmodified polyester resin, a release agent, a colorant, and a charge controlling agent, in an organic solvent. The toner constituents except the prepolymer may be added to an aqueous medium (this will be explained later) when the aqueous medium is prepared, or when the toner constituent solution or dispersion is added thereto.

(Compound Having Active Hydrogen Group)

The compound having an active hydrogen group acts as an elongation agent and/or a crosslinking agent when the polymer capable of reacting with the active hydrogen group is subjected to an elongation reaction and/or a crosslinking reaction in an aqueous medium.

According to one embodiment, any desired compounds having an active hydrogen group can be used as the compound having an active hydrogen group of the present invention, and are not limited to any particular compound. For example, when a polymer capable of reacting with the active hydrogen group is a polyester prepolymer (A) having an isocyanate group, an amine (B) is preferably used as the compound having an active hydrogen group, because the amine (B) can react with the polyester prepolymer (A) having an isocyanate group so as to prepare a high-molecular-weight polymer by an elongation reaction or a crosslinking reaction.

Specific examples of the active hydrogen groups include, but are not limited to: hydroxyl group (alcoholic hydroxyl group or phenolic hydroxyl group), amino group, carboxyl group, and mercapto group. As an example, these hydrogen groups can be used alone or in combination with each other. Among these hydrogen groups, alcoholic hydroxyl group is preferably used.

Any desired amines can be used as the amine (B) of the present invention. Specific exemplary examples of the amines (B) include, but are not limited to: diamines (B1), polyamines (B2) having three or more amino groups, amino alcohols (B3), amino mercaptans (B4), amino acids (B5), and blocked amines (B6) in which the amino groups in the amines (B1) to (B5) are blocked. As an example, these amines can be used alone or in combination. Among these amines (B), diamines (B1) and mixtures in which a diamine (B1) is mixed with a small amount of polyamine (B2) are preferably used.

Specific exemplary examples of the diamines (B1) include, but are not limited to: aromatic diamines such as phenylene diamine, diethyltoluene diamine, and 4,4'-diaminodiphenyl methane; alicyclic diamines such as 4,4'-diamino-3,3'-dimethyldicyclohexyl methane, diaminocyclohexane, and isophoronediamine; and aliphatic diamines such as ethylene diamine, tetramethylene diamine, and hexamethylene diamine.

Specific exemplary examples of the polyamines (B2) having three or more amino groups include, but are not limited to, diethylene triamine and triethylene tetramine.

Specific exemplary examples of the amino alcohols (B3) include, but are not limited to, ethanolamine and hydroxyethyl aniline.

Specific exemplary examples of the amino mercaptan (B4) include, but are not limited to, aminoethyl mercaptan and aminopropyl mercaptan.

Specific exemplary examples of the amino acids (B5) include, but are not limited to, amino propionic acid and amino caproic acid.

Specific exemplary examples of the blocked amines (B6) include, but are not limited to: ketimine compounds which are prepared by reacting one of the amines (B1) to (B5) with a ketone such as acetone, methyl ethyl ketone, and methyl isobutyl ketone; and oxazoline compounds.

According to one embodiment, when an elongation reaction and/or a crosslinking reaction between the compound having an active hydrogen group and the polymer capable of reacting with the active hydrogen group is stopped, a reaction stopping agent can be used. The reaction stopping agent is preferably used in terms of controlling the molecular weight of the reaction product (i.e., the resultant adhesive base material).

Specific exemplary examples of the reaction stopping agents include, but are not limited to, monoamines such as diethyl amine, dibutyl amine, butyl amine, and lauryl amine; and blocked amines, i.e., ketimine compounds prepared by blocking the monoamines mentioned above.

According to one embodiment, the mixing ratio (i.e., an equivalent ratio [NCO]/[NHx]) of the content of the polyester prepolymer (A) having an isocyanate group to the amine (B) is from 1/3 to 3/1, preferably from 1/2 to 2/1, and more preferably from 1/1.5 to 1.5/1. When the mixing ratio is too small, low-temperature fixability of the resultant toner deteriorates. When the mixing ratio is too large, the resultant urea-modified polyester resin has too low a molecular weight, resulting in deterioration of hot offset resistance of the resultant toner. (Polymer Capable of Reacting with Active Hydrogen Group)

As the polymer capable of reacting with an active hydrogen group (i.e., prepolymer), any desired compounds having a site capable of reacting with an active hydrogen group can be used, and are not limited to any particular compound. Specific examples of such polymers include, but are not limited to: polyol resins, polyacrylic resins, polyester resins, epoxyresins, and derivative resins thereof. As an example, these resins can be used alone or in combination with each other. Among these resins, polyester resins are preferably used because of having high fluidity and transparency when melted.

As the site capable of reacting with an active hydrogen group, which is included in the prepolymer in one embodiment, any desired functional groups can be used. Specific exemplary examples of the functional groups include, but are not limited to: isocyanate groups, epoxy groups, carboxylic groups, acid chloride groups, etc. As an example, these functional groups can be included in the prepolymer alone or in combination with each other. Among these functional groups, the isocyanate group is most preferably included therein.

Among the prepolymers, a polyester resin (RMPE) having a functional group capable of forming a urea bond is preferably used. According to one advantage, it is easy to control the molecular weight of the resultant resin when such a polyester resin is used, and therefore the resultant resin can impart good releasability and fixability to the resultant toner even if the fixing device includes no oil applying system, which applies a release oil to the heating medium for fixing.

Specific exemplary examples of the functional groups capable of forming a urea bond include the isocyanate group, or any other desired functional group. When a RMPE includes an isocyanate group as the functional group capable of forming a urea bond, the polyester prepolymer (A) having an isocyanate group is preferably used as the RMPE.

Specific exemplary examples of the polyester prepolymers (A) having an isocyanate group include compounds obtained by reacting (i) a base polyester formed by poly condensation reaction between a polyol (PO) and a polycarboxylic acid (PC), and having an active hydrogen group, with (ii) a polyisocyanate (PIC). Any other desired polyester prepolymers (A) having an isocyanate may be used.

In one embodiment, as the polyol (PO) or diols (DIO), polyols (TO) having three or more valences, and mixtures thereof can be used. As an example, these polyols can be used alone or in combination with each other. Among these polyols, diols (DIO) alone, and mixtures in which a diol (DIO) is mixed with a small amount of a polyol (TO) having three or more valences are preferably used.

Specific exemplary examples of the diols (DIO) include, but are not limited to: alkyleneglycols, alkyleneetherglycols, alicyclic diols, adducts of the alicyclic diolswithanalkylene oxide, bisphenols, and adducts of the bisphenols with an alkylene oxide.

Specific exemplary examples of the alkylene glycols include, but are not limited to: glycols having 2 to 12 carbon atoms such as ethylene glycol, 1,2-propylene glycol, 1,3-propylene glycol, 1,4-butanediol, and 1,6-hexanediol. Specific exemplary examples of the alkylene ether glycols include, but are not limited to, diethylene glycol, triethylene glycol, dipropylene glycol, polyethylene glycol, polypropylene glycol, and polytetramethylene ether glycol.

Specific exemplary examples of the alicyclicdiols include, but are not limited to, 1,4-cyclohexanedimethanol and hydrogenated bisphenol A. Specific exemplary examples of the adducts of the alicyclic diols with an alkylene oxide include, but are not limited to: the adducts of the alicyclic diol with ethylene oxide, propylene oxide, butylenes oxide, etc.

Specific exemplary examples of the bisphenols include, but are not limited to: bisphenol A, bisphenol F, and bisphenol S. Specific exemplary examples of the adducts of the bisphenols with an alkyleneoxide include, but are not limited to: the adducts of the bisphenol with ethylene oxide, propylene oxide, butylenes oxide, etc.

Among these glycols, alkylene glycols having 2 to 12 carbon atoms and adducts of bisphenols with an alkylene oxide are preferably used, and adducts of bisphenols with an alkylene oxide alone and mixtures thereof are more preferably used.

Specific exemplary examples of the polyols (TO) having three or more valences include, but are not limited to: multivalent aliphatic alcohols having three or more valences, polyphenols having three or more valences, and adducts of the polyphenols having three or more valences with an alkylene oxide.

Specific exemplary examples of the multivalent aliphatic alcohols having three or more valences include, but are not limited to: glycerin, trimethylolethane, trimethylolpropane, pentaerythritol, and sorbitol. Specific exemplary examples of the polyphenols having three or more valences include, but are not limited to: trisphenol PA, phenol novolac, and cresol novolac. Specific examples of the adducts of the polyphenols having three or more valences with an alkylene oxide include, but are not limited to: the adducts of the polyphenols having three or more valences with ethylene oxide, propylene oxide, butylenes oxide, etc.

According to one embodiment, the mixing ratio (i.e., DIO/TO) of the content of the diol (DIO) to the polyol (TO) having three or more valences is preferably from 100/0.01 to 100/10, and more preferably from 100/0.01 to 100/1.

As the polycarboxylic acid (PC), in one embodiment, dicarboxylic acids (DIC), polycarboxylic acids (TC) having three or more valences, and mixtures thereof can be used. As an example, polycarboxylic acids can be used alone or in combination with each other. Among these acids, dicarboxylic acids (DIC) alone, and mixtures in which a dicarboxylic acid (DIC) is mixed with a small amount of a polycarboxylic acid (TC) having three or more valences are preferably used.

Specific exemplary examples of the dicarboxylic acids (DIC) include, but are not limited to: alkylene dicarboxylic acids, alkenylene dicarboxylic acids, and aromatic dicarboxylic acids.

Specific exemplary examples of the alkylene dicarboxylic acids include, but are not limited to: succinic acid, adipic acid, and sebacic acid. Specific exemplary examples of the alkenylene dicarboxylic acids include, but are not limited to: alkenylene dicarboxylic acids having 4 to 20 carbon atoms such as maleic acid and fumaric acid. Specific examples of the aromatic dicarboxylic acids include, but are not limited to, aromatic dicarboxylic acids having 8 to 20 carbon atoms such as phthalic acid, isophthalic acid, terephthalic acid, and naphthalene dicarboxylic acid.

Among these acids, alkenylene dicarboxylic acids having 4 to 20 carbon atoms and aromatic dicarboxylic acids having 8 to 20 carbon atoms are preferably used.

Specific exemplary examples of the polycarboxylic acid (TC) having three or more valences include, but are not limited to, aromatic polycarboxylic acids.

Specific exemplary examples of the aromatic polycarboxylic acids include, but are not limited to, aromatic polycarboxylic acids having 9 to 20 carbon atoms such as trimellitic acid and pyromellitic acid.

As the polycarboxylic acid (PC), in one embodiment, acid anhydrides and lower alkyl esters of dicarboxylic acids (DIC), polycarboxylic acids (TC) having three or more valences, and mixtures thereof, can also be used. Suitable lower alkyl esters include, but are not limited to: methyl esters, ethyl esters, and isopropyl esters.

According to one embodiment, the mixing ratio (i.e., DIC/TC) of the content of the dicarboxylic acid (DIC) to the polycarboxylic acid (TC) having three or more valences is preferably from 100/0.01 to 100/10, and more preferably from 100/0.01 to 100/1.

A polyol (PO) and a polycarboxylic acid (PC) are mixed so that the equivalent ratio ([OH]/[COOH]) between a hydroxyl group [OH] and a carboxylic group [COOH] is typically from 2/1 to 1/1, preferably from 1.5/1 to 1/1, and more preferably from 1.3/1 to 1.02/1.

The polyester prepolymer (A) having an isocyanate group preferably includes, in one embodiment, a polyol (PO) unit in an amount of from 0.5 to 40% by weight, more preferably from 1 to 30% by weight, and much more preferably from 2 to 20% by weight, but the content of the polyol (PO) unit is not particularly limited. When the content is too small, hot offset resistance of the resultant toner deteriorates and the toner cannot have a good combination of thermostable preservability and low-temperature fixability. When the content is too large, low-temperature fixability of the resultant toner deteriorates.

Specific exemplary examples of the polyisocyanates (PIC) include, but are not limited to: aliphatic polyisocyanates, alicyclic polyisocyanates, aromatic diisocyanates, aromatic aliphatic diisocyanates, isocyanurates, phenol derivatives thereof, the above-mentioned polyisocyanates blocked with oxime, caprolactam, etc.

Specific exemplary examples of the aliphatic polyisocyanates include, but are not limited to: tetramethylene diisocyanate, hexamethylene diisocyanate, 2,6-diisocyanatemethyl caproate, octamethylene diisocyanate, decamethylene diisocyanate, dodecamethylene diisocyanate, tetradecamethylene diisocyanate, trimethylhexane diisocyanate, and tetramethylhexane diisocyanate.

Specific exemplary examples of the alicyclic polyisocyanates include, but are not limited to: isophorone diisocyanate and cyclohexylmethane diisocyanate. Specific exemplary examples of the aromatic diisocyanates include, but are not limited to: tolylene diisocyanate, diphenylmethane diisocyanate, 1,5-naphthylene diisocyanate, diphenylene-4,4'-diisocyanate, 4,4'-diisocyanato-3,3'-dimethyldiphenyl, 3-methyldiphenylmethane-4,4'-diisocyanate, and diphenylether-4,4'-diisocyanate. Specific exemplary examples of the aromatic aliphatic diisocyanates include, but are not limited to: $\alpha, \alpha, \alpha', \alpha'$-tetramethylxylylene diisocyanate. Specific exemplary examples of the isocyanurates include, but are not limited to: tris-isocyanatoalkyl-isocyanurate, and triisocyanatocycloalkyl-isocyanurate. As an example, these diisocyanates can be used alone or in combination with each other.

According to one embodiment, a polyisocyanate (PIC) is mixed with a polyester resin having an active hydrogen group (e.g., a polyester resin having a hydroxyl group) so that the equivalent ratio ([NCO]/[OH]) of isocyanate group [NCO] to hydroxyl group [OH] is typically from 5/1 to 1/1, preferably from 4/1 to 1.2/1 and more preferably from 3/1 to 1.5/1. When the ratio [NCO]/[OH] is too large, low temperature fixability of the resultant toner deteriorates. When the ratio [NCO]/[OH] is too small, hot offset resistance of the resultant toner deteriorates.

The polyester prepolymer (A) having an isocyanate group, in one embodiment, preferably includes a polyisocyanate (PIC) unit in an amount of from 0.5 to 40% by weight, preferably from 1 to 30% by weight, and more preferably from 2 to 20% by weight. When the content is too small, hot offset resistance of the resultant toner deteriorates and the toner cannot have a good combination of thermostable preservability and low-temperature fixability. When the content is too large, low-temperature fixability of the resultant toner deteriorates.

The average number of isocyanate groups included in a molecule of the polyester prepolymer (A), in one embodiment, is preferably 1 or more, more preferably from 1.2 to 5, and much more preferably from 1.5 to 4. When the number of isocyanate groups is less than 1 per molecule, the molecular weight of the urea-modified polyester decreases and hot offset resistance of the resultant toner deteriorates.

The polymer capable of reacting with an active hydrogen group preferably has a weight average molecular weight (Mw) of from 3,000 to 40,000, and more preferably from 4,000 to 30,000, when the molecular weight distribution of the tetrahydrofuran (THF) soluble components of the above polymer is determined by gel permeation chromatography (GPC). When the Mw is too small, thermostable preservability of the resultant toner deteriorates. When the Mw is too large, low-temperature fixability of the resultant toner deteriorates.

According to one embodiment, the molecular weight distribution can be measured with a gel permeation chromatography (GPC) system by the following method:

(1) columns are stabilized in a heat chamber at a temperature of 40° C,. and THF (i.e., column solvent) flows therein at a flow rate of 1 ml/min; and (2) from 50 to 200 μl of a sample solution of THF having a concentration of from 0.05 to 0.6% by weight is injected to the columns.

A molecular weight is calculated from a calibration curve (i.e., a relationship between molecular weight and count number) prepared using standard monodisperse polystyrenes.

For example, standard monodisperse polystyrenes (manufactured by Pressure Chemical Co. or Tosoh Corporation) having a molecular weight of $6\times10^2$, $2.1\times10^2$, $4\times10^2$, 1.75×

$10^4$, $1.1\times10^5$, $3.9\times10^5$, $8.6\times10^{5,\ 2\times106}$, and $4.48\times10^6$, can be used. It is preferable that at least 10 standard monodisperse-polystyrenes are used for preparing the calibration curve. As a detector, in one embodiment, a refractive index detector (RI) can be used.

(Aqueous Medium)

According to one embodiment, any desired aqueous media can be used in the present invention, and limited to any particular aqueous media. Specific exemplary examples of the aqueous media include, but are not limited to: water, solvents which can be mixed with water, and mixtures thereof. Among these aqueous media, water is preferably used.

Specific exemplary examples of the solvents which can be mixed with water include, but are not limited to: alcohols, dimethylformamide, tetrahydrofuran, cellosolves, and lower ketones.

Specific exemplary examples of the alcohols include, but are not limited to: methanol, isopropanol, and ethylene glycol. Specific exemplary examples of the lower ketones include, but are not limited to, acetone, and methyl ethyl ketone. As an example, these alcohols can be used alone or in combination with each other.

The aqueous medium for use in the present invention is prepared by dispersing a particulate resin in an aqueous medium. The aqueous medium preferably includes the particulate resin in an amount of from 0.1 to 3% by weight, but the amount is not limited to this range.

(Emulsification or Dispersion)

According to one embodiment, the toner constituent solution or dispersion is preferably emulsified or dispersed in an aqueous medium while agitated. Any desired dispersing methods can be used, and is not limited to any particular method. For example, any desired dispersing machines can be used. Specific exemplary examples of the dispersing machines include, but are not limited to, low shearing force type dispersing machines and high shearing force type dispersing machines.

In one embodiment, when the toner constituent solution or dispersion is emulsified or dispersed in an aqueous medium, the compound having an active hydrogen group and the polymer capable of reacting with the active hydrogen group are subjected to an elongation or cross-linking reaction and produce an adhesive base material.

(Adhesive Base Material)

According to one embodiment, the adhesive base material has adhesiveness to a recording medium such as a paper. The adhesive base material includes at least an adhesive polymer formed by reacting the compound having an active hydrogen group and the polymer capable of reacting with the active hydrogen group in an aqueous medium, and may include any known resins.

The adhesive base material preferably has a weight average molecular weight of not less than 3,000, more preferably from 5,000 to 1,000,000, and much more preferably from 7,000 to 500,000. When the weight average molecular weight is too small, hot offset resistance of the resultant toner deteriorates.

The adhesive base material preferably has a glass transition temperature (Tg) of from 30 to 70° C., and more preferably from 40 to 65° C. The toner of the present invention has good preservability even if the Tg is low, compared with conventional polyester toners, because of including a polyester resin prepared by an elongation or cross-linking reaction. When the Tg is too small, thermostable preservability of the resultant toner deteriorates. When the Tg is too large, low-temperature fixability of the resultant toner is poor.

As the adhesive base materials, in one embodiment, polyester resins are preferably used, but are not limited to those resins.

As the polyester resins, in one embodiment, urea-modified polyester resins are preferably used, but are not limited to these resins.

According to one embodiment, the urea-modified polyester resin can be prepared by reacting (i) an amine (B) serving as a compound having an active hydrogen group with (ii) a polyester prepolymer (A) having an isocyanate group, serving as a polymer capable of reacting with the active hydrogen group, in an aqueous medium.

In one embodiment, the urea-modified polyester resin may include a urethane bond other than the urea bond. In this case, the molar ratio of the urea bond to the urethane bond (i.e., urea bond/urethane bond) is preferably from 100/0 to 10/90, more preferably from 80/20 to 20/80, and much more preferably from 60/40 to 30/70. When the ratio is too small, hot offset resistance of the resultant toner deteriorates.

Specific exemplary examples of suitable urea-modified polyester resins include, but are not limited to, the following (1) to (10):

(1) a mixture of (i) a urea-modified compound of a polyester prepolymer, which is obtained by reacting isophorone diisocyanate with a polycondensation product between an ethylene oxide (2 mol) adduct of bisphenol A and isophthalic acid, obtained by using isophoronedi amine, and (ii) a polycondensation product between an ethylene oxide (2 mol) adduct of bisphenol A and isophthalic acid;

(2) a mixture of (i) a urea-modified compound of a polyester prepolymer, which is obtained by reacting isophorone diisocyanate with a polycondensation product between an ethylene oxide (2mol) adduct of bisphenol A and isophthalic acid, obtained by using isophorone diamine, and (ii) a polycondensation product between an ethylene oxide (2 mol) adduct of bisphenol A and terephthalic acid;

(3) a mixture of (i) a urea-modified compound of a polyester prepolymer, which is obtained by reacting isophorone diisocyanate with a polycondensation product between a mixture of an ethylene oxide (2 mol) adduct of bisphenol A and a propylene oxide (2 mol) adduct of bisphenol A, and terephthalic acid, obtained by using isophoronediamine, and (ii) a polycondensation product between a mixture of an ethylene oxide (2 mol) adduct of bisphenol A and a propylene oxide (2 mol) adduct of bisphenol A, and terephthalic acid;

(4) a mixture of (i) a urea-modified compound of a polyester prepolymer, which is obtained by reacting isophorone diisocyanate with a polycondensation product between a mixture of an ethylene oxide (2 mol) adduct of bisphenol A and a propylene oxide (2 mol) adduct of bisphenol A, and terephthalic acid, obtained by using isophoronediamine, and (ii) a polycondensation product between a propylene oxide (2 mol) adduct of bisphenol A and terephthalic acid;

(5) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using hexamethylene diamine, and (ii) a polycondensation product between an ethyleneoxide (2 mol) adduct of bisphenol A and terephthalic acid;

(6) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using hexamethylene diamine, and (ii) a polycondensation product between a mixture of an ethylene oxide (2 mol) adduct of bisphenol A and a propylene oxide (2 mol) adduct of bisphenol A, and terephthalic acid;

(7) a mixture of (i) a urea-modified compound of a polyester prepolymer, which is obtained by reacting isophorone diisocyanate with a polycondensation product between an ethylene oxide (2 mol) adduct of bisphenol A and terephthalic acid, obtained by using ethylene diamine, and (ii) a polycondensation product between an ethylene oxide (2 mol) adduct of bisphenol A and terephthalic acid;

(8) a mixture of (i) a urea-modified compound of a polyester prepolymer, which is obtained by reacting diphenylmethane diisocyanate with a polycondensation product between an ethylene oxide (2 mol) adduct of bisphenol A and isophthalic acid, obtained by using hexamethylene diamine, and (ii) a polycondensation product between an ethylene oxide (2 mol) adduct of bisphenol A and isophthalic acid;

(9) a mixture of (i) a urea-modified compound of a polyester prepolymer, which is obtained by reacting diphenylmethane diisocyanate with a polycondensation product between a mixture of an ethylene oxide (2 mol) adduct of bisphenol A and a propylene oxide (2 mol) adduct of bisphenol A, and a mixture of terephthalic acid and dodecenyl succinic anhydride, obtained by using hexamethylene diamine, and (ii) a polycondensation product between a mixture of an ethylene oxide (2 mol) adduct of bisphenol A and a propylene oxide (2 mol) adduct of bisphenol A, and isophthalic acid; and

(10) a mixture of (i) a urea-modified compound of a polyester prepolymer, which is obtained by reacting toluene diisocyanate with a polycondensation product between an ethylene oxide (2 mol) adduct of bisphenol A an disophthalic acid, obtained by using hexamethylene diamine, and (ii) a polycondensation product between an ethylene oxide (2 mol) adduct of bisphenol A and isophthalic acid.

(Binder Resin)

According to one embodiment, any desired resins can be used as the binder resin, and are not limited to any particular resin. Specific exemplary examples of the binder resins include, but are not limited to, polyester resins. Among the polyester resins, unmodified polyester resins are preferably used.

The toner including the unmodified polyester resin has good low temperature fixability and produces images having high glossiness.

Specific exemplary examples of the unmodified polyester resins include, but are not limited to: polycondensation products between a polyol (PO) and a polycarboxylic acid (PC), as same as the polyester resin (RMPE) having a functional group capable of forming a urea bond. In one embodiment, the unmodified polyester resin is partially compatible with the RMPE, i.e., these resins have similar structures, in terms of improving low temperature fixability and hot offset resistance of the resultant toner.

According to one embodiment, the unmodified polyester resin preferably has a weight average molecular weight (Mw) of from 1,000 to 30,000, and more preferably from 1,500 to 15,000, when the molecular weight distribution of the tetrahydrofuran (THF) soluble components is determined by GPC (gel permeation chromatography). When the weight average molecular weight (Mw) is too small, thermostable preservability of the resultant toner deteriorates. For this reason, the toner preferably includes the components having a weight average molecular weight (Mw) of less than 1,000 in an amount of from 8 to 28% by weight. When the weight average molecular weight (Mw) is too large, low temperature fixability of the resultant toner deteriorates.

In one embodiment, the unmodified polyester resin preferably has a glass transition temperature from 35 to 70° C. When the glass transition temperature is too low, thermostable preservability of the resultant toner deteriorates. When the glass transition temperature is too high, low temperature fixability of the resultant toner deteriorates.

The unmodified polyester resin preferably has a hydroxyl value of not less than 5 mgKOH/g, more preferably from 10 to 120 mgKOH/g, and much more preferably from 20 to 80 mgKOH/g. When the hydroxyl value is too small, the resultant toner hardly has a good combination of thermostable preservability and low temperature fixability.

According to one embodiment, the unmodified polyester resin preferably has an acid value of from 1.0 to 30.0 mgKOH/g, and more preferably from 5.0 to 20.0 mgKOH/g. Generally speaking, toners having an acid value can be easily negatively charged.

In one embodiment, the mixing ratio (i.e., RMPE/PE) of the polyester resin (RMPE) having a functional group capable of forming a urea bond to the unmodified polyester resin (PE) is preferably from 5/95 to 25/75, and more preferably from 10/90 to 25/75, by weight.

When the mixing ratio is too small, hot offset resistance of the resultant toner deteriorates. When the mixing ratio is too large, low temperature of the resultant toner deteriorates and the produced images have low glossiness.

In one embodiment, the binder resin preferably includes the unmodified polyester resin in an amount of from 50 to 100% by weight, and more preferably from 55 to 95% by weight. When the amount is too small, low temperature fixability, fixing strength, glossiness of the resultant toner image deteriorates.

The following exemplary methods are suitable for preparing the adhesive base material.

(1) A toner constituent solution or dispersion containing a polymer capable of reacting with an active hydrogen group (e.g., the polyester prepolymer (A) having an isocyanate group) is emulsified or dispersed in an aqueous medium together with a compound having an active hydrogen group (e.g., the amine (B)), to prepare a dispersion of the toner constituent solution or dispersion while subjecting the compound having an active hydrogen group and the polymer capable of reacting with the active hydrogen group to an elongation and/or crosslinking reaction.

(2) The toner constituent solution or dispersion is emulsified or dispersed in an aqueous medium previously containing a compound having an active hydrogen group, to prepare a dispersion of the toner constituent solution or dispersion while subjecting the compound having an active hydrogen group and the polymer capable of reacting with the active hydrogen group to an elongation and/or crosslinking reaction.

(3) The toner constituent solution or dispersion is emulsified or dispersed in an aqueous medium, and then the compound having an active hydrogen group is added thereto, to prepare a dispersion of the toner constituent solution or dispersion while subjecting the compound having an active hydrogen group and the polymer capable of reacting with the active hydrogen group to an elongation and/or crosslinking reaction.

In the above method (3), a modified polyester resin is selectively formed on the surface of the produced toner particles, i.e., the resultant toner can have a desired concentration gradient thereof.

The reaction conditions for preparing the adhesive base material are limited to the aforementioned conditions, and depend on a combination of a compound having an active hydrogen group and a polymer capable of reacting with the active hydrogen group. However, the reaction time is preferably from 10 minutes to 40 hours, and more preferably from 2 to 24 hours.

According to one embodiment, to stably form an aqueous dispersion containing the polymer capable of reacting with an active hydrogen group (e.g., the polyester prepolymer (A) having an isocyanate group), it is preferable that a toner constituent solution or dispersion, which is prepared by dissolving or dispersing the polymer capable of reacting with an active hydrogen group (e.g., the polyester prepolymer (A) having an isocyanate group), a colorant, a charge controlling agent, a unmodified polyester resin, etc., in an organic solvent, is dispersed in an aqueous medium upon application of shear force.

It is preferable that the content of the aqueous medium, in one embodiment, used for the emulsification or dispersion is 50 to 2,000 parts by weight, and more preferably 100 to 1,000 parts by weight, based on 100 parts by weight of the toner constituents. When the content is too small, the toner constituent solution or dispersion cannot be well dispersed, and therefore the toner cannot have a desired particle diameter. When the content is too large, the toner manufacturing cost increases.

(Dispersant)

When the toner constituent solution or dispersion is emulsified or dispersed in an aqueous medium, in one embodiment, a dispersant is preferably used to improve stability of the dispersion so as to obtain a toner having a desired shape and a narrow particle diameter distribution.

In one embodiment, any desired dispersants can be used in combination with the particulate resin in the present invention, and are not limited to any particular resin. Specific exemplary examples of the dispersants include, but are not limited to: surfactants, water-insoluble inorganic dispersants, and polymeric protection colloids. As an example, these dispersants can be used alone or in combination with each other. Among these dispersants, surfactants are preferably used.

Specific exemplary examples of the surfactants include, but are not limited to: anionic surfactants, cationic surfactants, nonionic surfactants, and ampholytic surfactants.

Specific exemplary examples of the anionic surfactants include, but are not limited to: alkylbenzene sulfonic acid salts, α-olefin sulfonic acid salts, and phosphoric acid salts. In one embodiment, anionic surfactants having a fluoroalkyl group are preferably used.

Specific exemplary examples of the anionic surfactants having a fluoroalkyl group include, but are not limited to, fluoroalkyl carboxylic acids having 2 to 10 carbon atoms and metal salts thereof, disodiumperfluorooctanesulfonylglutamate, sodium3-{ω-fluoroalkyl (C6-C11) oxy}-1-alkyl(C3-C4) sulfonate, sodium 3-{ω-fluoroalkanoyl (C6-C8)-N-ethylamino}-1-propanesulfonate, fluoroalkyl (C11-C20) carboxylic acids and metal salts thereof, perfluoroalkyl (C7-C13) carboxylic acids and metal salts thereof, perfluoroalkyl (C4-C12) sulfonate and metal salts thereof, perfluorooctanesulfonic acid diethanol amide, N-propyl-N-(2-hydroxyethyl)perfluorooctanesulfone amide, perfluoroalkyl (C6-C10) sulfone amidepropyltrimethyl ammonium salts, salts of perfluoroalkyl (C6-C10)-N-ethylsulfonylglycin, and monoperfluoroalkyl (C6-C16) ethylphosphates.

Specific exemplary examples of useable commercially available surfactants include, but are not limited to: SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP®EF-102, 103, 104, 105, 112, 123A, 123B, 306A, 501, 201 and 204, which are manufactured by Tochem Products Co., Ltd.; and FUTARGENT® F-100 and F-150 manufactured by Neos.

Specific exemplary examples of the cationic surfactants include, but are not limited to, amine salts and quaternary ammonium salts.

Specific exemplary examples of the amine salts include, but are not limited to: alkyl amine salts, aminoalcohol fatty acid derivatives, polyamine fatty acid derivatives, and imidazoline. Specific exemplary examples of the quaternary ammonium salts include, but are not limited to: alkyltrimethyl ammonium salts, dialkyldimethyl ammonium salts, alkyldimethyl benzyl ammonium salts, pyridinium salts, alkyl isoquinolinium salts, and benzethonium chloride.

In one embodiment, primary, secondary and tertiary aliphatic amines having a fluoroalkyl group, aliphatic quaternary salts such as perfluoroalkyl (C6-C10) sulfoneamidepropyltrimethyl ammonium salts, benzalkonium salts, benzetonium chloride, pyridinium salts, and imidazolinium salts are preferably used.

Specific exemplary examples of useable commercially available products thereof include, but are not limited to: SARFRON® S-121 (from Asahi Glass Co., Ltd.); FLUORAD® FC-135 (from Sumitomo 3M Ltd.); UNIDYNE®DS-202 (from Daikin Industries, Ltd.); MEGAFACE® F-150 and F-824 (from Dainippon Ink and Chemicals, Inc.); ECTOP® EF-132 (from Tohchem Products Co., Ltd.); and FUTARGENT® F-300 (from Neos).

Specific exemplary examples of the nonionic surfactants include, but are not limited to: fatty acid amine derivatives and polyhydric alcohol derivatives.

Specific exemplary examples of the ampholytic surfactants include, but are not limited to: aniline, dodecyldi(aminoethyl) glycin, di(octylaminoethyl)glycin, and N-alkyl-N,N-dimethylammonium betaine.

Specific exemplary examples of the water-insoluble inorganicdispersants include, but arenotlimitedto: tricalcium phosphate, calciumcarbonate, titaniumoxide, colloidal silica, and hydroxyapatite.

Specific exemplary examples of the polymeric protection colloids include, but are not limited to: homopolymers and copolymers prepared using monomers such as acids, (meth) acrylic monomers having a hydroxyl group, vinyl alcohols and ethers thereof, esters of a vinyl alcohol with a compound having a carboxyl group, amide compounds and methylol compounds thereof, chlorides, and monomers having a nitrogen atom or a heterocyclic ring having a nitrogen atom; polyoxyethylene compounds; and cellulose compounds.

Specific exemplary examples of the acids include, but are not limited to, acrylic acid, methacrylic acid, α-cyanoacrylic acid, α-cyanomethacrylic acid, itaconic acid, crotonic acid, fumaric acid, maleic acid, and maleic anhydride.

Specific exemplary examples of the (meth)acrylic monomers having a hydroxyl group include, but are not limited to: β-hydroxyethyl acrylate, β-hydroxyethyl methacrylate, β-hydroxypropyl acrylate, β-hydroxypropyl methacrylate, γT-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide.

Specific exemplary examples of the vinyl alcohols and ethers thereof include, but are not limited to: vinyl methyl ether, vinyl ethyl ether, and vinyl propyl ether. Specific exemplary examples of the esters of avinyl alcohol with a compound having a carboxyl group include, but are not limited to: vinyl acetate, vinyl propionate, and vinyl butyrate. Specific exemplary examples of the amide compounds and methylol compounds thereof include, but are not limited to, acrylamide, methacrylamide, diacetoneacrylamide acid, and methylol compounds thereof.

Specific exemplary examples of the chlorides include, but are not limited to, acrylic acid chloride and methacrylic acid chloride.

Specific exemplary examples of the monomers having a nitrogen atom or a heterocyclic ring having a nitrogen atom include, but are not limited to: vinyl pyridine, vinyl pyrrolidone, vinyl imidazole, and ethylene imine.

Specific exemplary examples of the polyoxyethylene compounds include, but are not limited to: polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Specific exemplary examples of the cellulose compounds include, but are not limited to: methyl cellulose, hydroxyethyl cellulose, and hydroxypropyl cellulose.

According to one embodiment, when the dispersion is prepared, a dispersion stabilizer can be optionally used. Specific exemplary examples of the dispersion stabilizers include, but are not limited to, calcium phosphate, which is soluble both in acids and bases. In one embodiment, when the compound soluble both in acids and bases are used as a dispersion stabilizer, the dispersion stabilizer can be removed by being dissolved by acids such as hydrochloric acid, followed by washing with water, or being decomposed by an enzyme.

When the dispersion is prepared, in one embodiment, a catalyst of the elongation and/or crosslinking reaction can be optionally used. Specific exemplary examples of the catalysts include, but are not limited to, dibutyltin laurate and dioctyltin laurate.

(Solvent Removal)

According to one embodiment, the organic solvent is removed from the dispersion (i.e., emulsion slurry). To remove an organic solvent from the emulsion, the following exemplary methods can be used:

(1) The emulsion is gradually heated to completely evaporate the organic solvent present in the drops of the oil phase; or (2) The emulsion is sprayed in a dry environment to dry the organic solvent in the drops of the oil phase and water in the dispersion, resulting in formation of toner particles.

After the organic solvent is removed, toner particles are obtained. In one embodiment, the toner particles are subjected to washing and drying treatment, and then, in an alternative embodiment, subjected to classification. In one embodiment, the toner particles can be classified by removing fine particles by methods such as cyclone, decantation, and centrifugal separation in a liquid. Additionally, in one embodiment, the dried toner particles can be classified by the above aforementioned methods.

According to one embodiment, the dried toner particles can be mixed with other particulate materials such as a colorant, a release agent, and a charge controlling agent optionally upon application of a mechanical impact thereto to fix and fuse the particulate materials on the surface of the toner particles.

Specific exemplary examples of such mechanical impact application methods include, but are not limited to, methods in which a mixture is mixed with a highly rotated blade and methods in which a mixture is put into air to collide the particles against each other or a collision plate.

Specific exemplary examples of such mechanical impact applicators include, but are not limited to: ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTON SYSTEM (manufactured by Kawasaki Heavy Industries, Ltd.), and automatic mortars.

Suspension Polymerization Method

In the suspension polymerization method, in one embodiment, a toner is manufactured by emulsifying or dispersing (suspending) a toner constituent solution or dispersion in an aqueous medium to prepare toner particles.

(Toner Constituent Solution or Dispersion)

The toner constituent solution or dispersion used for the suspension polymerization method, in one embodiment, is prepared by dissolving or dispersing a colorant, a release agent, a charge controlling agent, etc. in a monomer and an oil-soluble polymerization initiator. To decrease the viscosity of the resultant polymer produced by the after-mentioned polymerization reaction, in one embodiment, an organic solvent, a polymer, a dispersant, etc., can be optionally added thereto alone or in combination with each other.

(Monomer)

By partially using monomers such as acids, in one embodiment, (e.g., acrylic acid, methacrylic acid, α-cyanoacrylic acid, α-cyanomethacrylic acid, itaconic acid, crotonic acid, fumaric acid, maleic acid, maleic anhydrides); acrylamide, methacrylamide, diacetoneacrylamide, and methylol compounds thereof; and vinylpyridine, vinylpyrrolidone, vinylimidazole, ethyleneimine, and acrylates and methacrylates having an amino group (e.g., dimethyl aminoethyl methacrylate), a functional group can be introduced to the surface of the resultant toner. In addition, in an alternative embodiment, a functional group can be introduced to the surface of the resultant toner by adsorbing a dispersant having an acid group or a basic group thereto.

Specific exemplary examples of the monomers include, but are not limited to: styrene monomers (e.g., styrene, o-methylstyrene, m-methylstyrene, p-methylstyrene, p-methoxystyrene, p-ethylstyrene), acrylates (e.g., methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, phenyl acrylate), methacrylates (e.g., methyl methacrylate, ethyl methacrylate, n-propyl methacrylate, n-butyl methacrylate, isobutyl methacrylate, n-octyl methacrylate, dodecylmethacrylate, 2-ethylhexylmethacrylate, stearyl methacrylate, phenyl methacrylate, dimethylaminoethyl methacrylate, diethylaminoethyl methacrylate), acrylonitrile, methacrylonitrile, and acrylamide.

As an example, resins can be used in combination with the above monomers. For example, since a monomer having a hydrophilic functional group (e.g., amino group, carboxylicacid group, hydroxyl group, sulfone group, glycidyl group, nitrile group) is water-soluble and dissolved in an aqueous suspension, these monomers cannot be emulsion-polymerized. Therefore, if the above monomer is introduced to the resultant toner, random, block and graft copolymers thereof with a vinyl compounds such as styrene and ethylene; polycondensation resins thereof such as polyester and polyamide; and polyaddition resins thereof such as polyether and polyimine can be used.

Next, alcohols and carboxylic acids for preparing a polyester resin will be explained in detail.

Specific exemplary examples of the alcohols for forming the polyester resin include, but are not limited to, ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, and hydrogenatedbisphenol A. In alternative embodiments, polyols such as glycerin, pentaerythritol, sorbitol, sorbitan, and oxyalkylene ethers of novolac phenol resins can also be used.

Specific exemplary examples of the acids include, but are not limited to, divalent carboxylic acids such as benzene dicarboxylic acids and anhydride thereof (e.g., phthalic acid, terephthalic acid, isophthalic acid, phthalicanhydride), alkyl dicarboxylic acid and anhydrides thereof (e.g., succinic acid, adipic acid, sebacic acid, azelaic acid), succinic acids substituted with an alkyl or alkenyl group having 6 to 18 carbon atoms and anhydrides thereof, and unsaturated dicarboxylic acids and anhydrides thereof (e.g., fumaric acid, maleic acid, citraconic acid, itaconic acid). In alternative embodiments, polycarboxylic acids such as trimellitic acid, pyromellitic acid, 1,2,3,4-butane tetracarboxylic acid, benzophenone tetracarboxylic acid, and anhydrides thereof can also be used.

The polyester resin preferably includes, in one embodiment, the alcohol in an amount of from 45 to 55% by mol and the acid in an amount of from 45 to 55% by mol.

According to one embodiment, two or more polyester resins can be used in combination unless properties of the resultant toner deteriorate. The properties of the polyester resin can be controlled, in one embodiment, by modifying the polyester resin with a silicone, a compound having a fluoroalkyl group, etc.

In one embodiment, such a polymer having a polar functional group preferably has an average molecular weight of not less than 5,000.

In alternative embodiments, the following resins can also be used in combination with the above monomers: homopolymers of styrene and derivatives thereof (e.g.,polystyrene, polyvinyl toluene), styrene copolymers (e.g., styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, styrene-maleate copolymer), polymethyl methacrylate, polybutyl methacrylate, polyvinyl acetate, polyethylene, polypropylene, polyvinyl butyral, silicone resin, polyester resin, polyamide resin, epoxy resin, polyacrylic acid resin, rosin, modified rosin, terpene resin, phenol resin, aliphatic or alicyclic hydrocarbon resin, and aromatic petroleum resin. As an example, these monomers can be used alone or in combination with each other.

In one embodiment, the added amount of the resin is preferably from 1 to 20 parts by weight based on 100 parts by weight of the monomer. When the added amount is too small, the resin cannot exert its effect to control the toner properties. When the added amount is too large, it is difficult to design the toner properties.

A polymer having a molecular weight different from that of the resultant polymer, which is obtained by polymerizing the monomer, can be dissolved, in one embodiment, in the monomer to be polymerized.

(Oil-Soluble Polymerization Initiator)

When 0.5 to 20 parts by weight of an oil-soluble polymerization initiator having a half-life from 0.5 to 30 hours is added, in one embodiment, to 100 parts of the monomer when polymerized, a polymer having a local maximum molecular weight of from 10,000 to 100,000 can be obtained. Such a polymer can impart proper strength and solubility to the resultant toner.

Specific exemplary examples of the oil-soluble polymerization initiators include, but are not limited to, azo and diazo polymerization initiators (e.g., 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile), and peroxide polymerization initiators (e.g., benzoyl peroxide, methyl ethyl ketoneperoxide, diisopropylperoxy carbonate, cumene hydroperoxide, 2,4-dichlorobenzoyl peroxide, lauroyl peroxide, t-butylperoxy-2-ethyl hexanoate)

(Other Components)

In other embodiments, the toner may include other components such as a colorant, a release agent, a charge controlling agent, and a cross-linking agent, if desired.

(Colorant)

In one embodiment, any desired colorants such as carbon blacks, yellow colorants, magenta colorants, and cyan colorants can be used for the toner.

Specific exemplary examples of the yellow colorants include, but are not limited to: condensation azo compounds, isoindolinone compounds, anthraquinone compounds, azo metal complexes, methyne compounds, and arylamide compounds. More specifically, C. I. Pigment Yellow 12, 13, 14, 15, 17, 62, 74, 83, 93, 94, 95, 109, 110, 111, 128, 129, 147, 168 and 180 are preferably used.

Specific exemplary examples of the magenta colorants include, but are not limited to: condensation azo compounds, diketopyrrolopyrrole compounds, anthraquinone compounds, quinacridone compounds, basic dye lake compounds, naphthol compounds, benzimidazolone compounds, thioindigo compounds, and perylene compounds. More specifically, C. I. Pigment Red 2, 3, 5, 6, 7, 23, 48:2, 48:3, 48:4, 57:1, 81:1, 122, 146, 166, 169, 177, 184, 185, 202, 206, 220, 221 and 254 are preferably used.

Specific exemplary examples of the cyan colorants include, but are not limited to: copper phthalocyanine compounds and derivatives thereof, anthraquinone compounds, and basic dye lake compounds. More specifically, C. I. Pigment Blue 1, 7, 15, 15:1, 15:2, 15:3, 15:4, 60, 62 and 66 are preferably used.

As an example, these colorants can be used alone or in combination with each other. The colorant may be used, in one embodiment, as a solid solution state. The colorant is selected considering color hue, saturation, brightness, weather resistance, OHP transparency, dispersibility in the toner, etc.

The toner preferably includes, in one embodiment, the colorant in an amount of from 1 to 20 parts by weight based on 100 parts by weight of the binder resin.

(Release Agent)

Specific exemplary examples of the release agent include, but are not limited to: petroleum waxes (e.g., paraffin wax, microcrystalline wax, petrolactam) and derivatives thereof; montan waxes and derivatives thereof; hydrocarbon waxes prepared by Fisher-Tropsch method and derivatives thereof; polyolefin waxes (e.g., polyethylene) and derivatives thereof; and natural waxes (e.g., carnauba wax, candelilla wax) and derivatives thereof. These derivatives include oxides, block copolymers withavinyl monomer, graft compounds, etc. In other embodiments, higher aliphatic alcohols, fatty acids (e.g., stearic acid, palmitic acid) and compounds thereof, acid amide waxes, ester waxes, ketones, hydrogenated castor oil and derivatives thereof, plant waxes, animal waxes, etc. can also be used.

(Charge Controlling Agent)

According to one embodiment, any desired charge controlling agents can be used for the toner. When the toner is manufactured by polymerization methods, charge controlling agents which hardly inhibits the polymerization and dissolves in an aqueous medium are preferably used.

Specific exemplary examples of the negative charge controlling agents include, but are not limited to: metal compounds of aromatic carboxylic acids (e.g., salicylic acid, alkyl salicylic acid, dialkyl salicylic acid, naphthoic acid, dicarboxylic acid), metal salts and metal complexes of azo dyes and azo pigments, polymer compounds having a side chain including sulfonic acid group or carboxylic acid group, boron compounds, urea compounds, silicon compounds, and calixarene.

Specific exemplary examples of the positive charge controlling agents include, but are not limited to: quaternary ammonium salts, polymer compounds having a side chain including a quaternary ammonium salt, guanidine compounds, nigrosine compounds, and imidazole compounds.

The charge controlling agents can be both added internally or, in an alternative embodiment, externally to mother toner particles. The content of the charge controlling agent is determined, in one embodiment, depending on the species of the binder resin used, whether or not an additive is added and a toner manufacturing method (such as dispersion method) is used.

The content of the charge controlling agent is not limited to any particular mixture. However, the content of the charge controlling agent is preferably from 0.1 to 10 parts by weight, and more preferably from 0.1 to 5 parts by weight, based on 100 parts by weight of the binder resin. When the charge controlling agent is externally added, the content is preferably 0.005 to 1.0 parts by weight, and more preferably 0.01 to 0.3 parts by weight, based on 100 parts by weight of the toner.

(Cross-Linking Agent)

According to one embodiment, any desired cross-linking agents can be used for the toner. Compounds having 2 or more double bonds capable of polymerization are preferably used. Specific exemplary examples of such compounds include, but are not limited to: aromaticdivinyl compounds (e.g., divinylbenzene, divinylnaphthalene), carboxylate having 2 double bonds (e.g., ethylene glycol diacrylate, ethylene glycol dimethacrylate, 1,3-butanediol dimethacrylate), divinyl compounds (e.g., divinyl aniline, divinyl ether, divinyl sulfone), and compounds having 3 or more vinyl groups. As an example, these compounds are can be used alone or in combination with each other.

In one embodiment, the content of the cross-linking agent is preferably from 0.01 to 15 parts by weight, based on 100 parts by weight of the monomer.

(Aqueous Medium)

According to one embodiment, any desired aqueous media can be used. For example, water can be used in one embodiment.

The aqueous medium preferably includes, in one embodiment, a dispersion stabilizer other than the particulate resin.

As the dispersion stabilizer, in one embodiment, any desired surfactants, organic dispersants, inorganic dispersants, etc. can be used. Among these dispersants, inorganic dispersants are preferably used because these dispersants have the following desired properties.

(1) ultrafine particles are hardly produced;

(2) having good stability owing to its steric hindrance;

(3) stably keeping dispersing ability even if the reaction temperature is varied; and (4) easy to be washed.

Specific exemplary examples of the inorganic dispersants include, but are not limited to: polyvalent metal salts of phosphoric acid (e.g., calcium phosphate, magnesium phosphate, aluminum phosphate, zinc phosphate), carbonates (e.g., calcium carbonate, magnesium carbonate), inorganic salts (e.g., calcium metasilicate, calcium sulfate, barium sulfate), calcium hydroxide, magnesium hydroxide, and inorganic oxides (e.g., silica, bentonite, alumina).

In one embodiment, the inorganic dispersant may be used without modifications. The inorganic dispersant may also be produced, in one embodiment, in the aqueous medium to obtain much finer particles. For example, in one embodiment, calcium phosphate, which is insoluble in water, can be prepared by mixing an aqueous solution of sodium phosphate and that of calcium chloride under high-speed agitation. The thus prepared calcium phosphate, in one embodiment, can be finely dispersed in water. In this embodiment, water-soluble sodium chloride is produced as a by-product. When such a water-soluble salt is present in the aqueous medium, the monomer is prevented from dissolving in the aqueous medium. Thereby, ultrafine toner particles are hardly produced by emulsion polymerization. However, when residual monomer is removed in the terminal stage of the polymerization, the water-soluble salt is obstructive. Therefore, it is preferable, in one embodiment, that the aqueous medium is replaced or the salt is removed using an ion-exchange resin. The inorganic dispersant can be almost completely removed by being dissolved by an acid or a base after the polymerization is terminated.

The inorganic dispersant is preferably added, in one embodiment, alone in an amount of from 0.2 to 20 parts by weight basedon 100 parts by weight of the monomer. But it is difficult to obtain a toner having a small particle diameter when the inorganic dispersant is used alone, although ultrafine particles are hardly produced. Therefore, it is preferable, in an alternative embodiment, that 0.001 to 0.1 parts by weight of a surfactant is added together.

Specific exemplary examples of the surfactants include, but are not limited to: sodium dodecylbenzene sulfate, sodium tetradecyl sulfate, sodium pentadecyl sulfate, sodium octyl sulfate, sodium oleate, sodium laurate, sodium stearate, and potassium stearate.

(Suspension)

According to one embodiment, a suspension is prepared by emulsifying or dispersing the toner constituent solution or dispersion in which toner constituents are uniformly dissolved or dispersed in the aqueous medium. If the toner constituent solution or dispersion is dispersed using a high-speed disperser such as a high-speed stirrer or an ultrasonic disperser so that dispersed particles have a targeted particle diameter, the resultant toner has a sharp particle diameter distribution.

In one embodiment, the oil-soluble polymerization initiator may be added to the monomer together with other toner constituents, or to the aqueous medium immediately before the toner constituent solution or dispersion is added thereto. Further, in other embodiments, a solvent or a monomer, in which the oil-soluble polymerization initiator is dissolved, may be added while a toner is granulated, immediately after a toner is granulated, or before the polymerization reaction starts.

(Granulation)

According to one embodiment, the granulation is performed by polymerizing the monomer.

The monomer is polymerized, in one embodiment, at a temperature of not less than 40° C. and preferably from 50 to 90° C. In this embodiment, toner components intended to be internally incorporated in the toner such as a release agent and a wax, are phase-separated. As a result, these components are easily incorporated inside the toner. In another embodiment where the polymerization is performed at a temperature from 90 to 150° C. so that the residual monomer is reacted, the release agent and the resin tends to be compatible with each other because the release agent is heated to a temperature greater than the melting point thereof. Therefore, the polymerization should be performed at a temperature of not greater than the melting point of the release agent. In particular, the polymerization is preferably performed at a temperature of not greater than 100° C.

The granulation is also performed, in another embodiment, by a seed polymerization method in which a monomer is adsorbed to polymerized particles and then polymerized using an oil-soluble polymerization initiator. In this embodiment, a polar compound can be dissolved or dispersed in the monomer adsorbed to the polymerized particles.

After the polymerization is terminated, the reaction products, in one embodiment, are preferably agitated with a typical agitator at an agitation rate so that the resultant particles are kept in a particle state and prevented from floating and settling.

According to one embodiment, the polymerized particles are filtered, washed so as to remove the surfactant, dried, and mixed with a particulate inorganic material. Thus, the resultant toner particles are prepared. It is preferable that the classification is performed so as to remove coarse and fine particles.

Fluidizer

The toner for use in the present invention, in one embodiment, preferably includes a particulate inorganic material having a number average primary particle diameter of from 4 to 80 nm as a fluidizer.

Specific exemplary examples of the particulate inorganic materials include, but are not limited to: silica, alumina, and titanium oxide.

Specific exemplary examples of the silica include, but are not limited to, a dry silica (i.e., fumed silica) prepared by vapor phase oxidation of a halogenated silicon compound and a wet silica prepared from a liquid glass. Among these silica, a dry silica including in an amount of as smaller as possible of silanol group on the surface and inside thereof, and manufacturing residues such as $Na_2O$ and $SO_3$—. When the dry silica is prepared, in one embodiment, using a halogenated metal compound such as aluminum chloride and titanium chloride together with a halogenated silicon compound, a composite material of a silica and a halogenated metal compound can be obtained and used as a fluidizer.

To impart good fluidity to the toner, the particulate inorganic material preferably has a specific surface area measured by nitrogen adsorption BET method of from 20 to 350 $m^2/g$, and more preferably from 25 to 300 $m^2/g$.

The specific surface area can be measured, in one embodiment, using a specific surface area measurement device (AUTOSORB-1 from Yuasa Ionics Inc.) according to a BET method in which nitrogen gas is adsorbed to the surface of the sample and the specific surface area is calculated by BET multi-point method.

The content of the particulate inorganic material, in one embodiment, is preferably from 0.1 to 3.0% by weight based on total weight of the mother toner particles. When the content is too small, fluidity of the resultant toner deteriorates. When the content is too large, fixability of the resultant toner deteriorates.

The content of the particulate resin can be determined, in one embodiment, by a fluorescent X-ray analysis, for example, using a calibration curve prepared using standard samples.

The particulate inorganic material, in one embodiment, is preferably hydrophobized in view of maintaining good properties even under high temperature and high humidity conditions.

Specific exemplary examples of the hydrophobizing agents include, but are not limited to: silicone varnishes, modified silicone varnishes, silicone oils, modified silicone oils, silane compounds, silane coupling agents, organic silicone compounds, and organic titanium compounds. As an example, these agents can be used alone or in combination.

Specific exemplary examples of the hydrophobizing methods include, but are not limited to, a method including a first reaction in which silanol groups are disappeared by a silylation reaction and a second reaction in which a hydrophobic thin layer is formed on the surface of the particulate inorganic material.

The silicone oil preferably has, in one embodiment, a viscosity of from 10 to 200,000 $mm^2/s$, and more preferably from 3,000 to 80,000 $mm^2/s$, at a temperature of 25° C. When the viscosity is too small, the hydrophobized particulate inorganic material has too unstable properties, and therefore the resultant image tends to deteriorate when a thermal or mechanical force is applied thereto. When the viscosity is too large, it is difficult to uniformly hydrophobizing the particulate inorganic material.

Specific exemplary examples of the silicone oils include, but are not limited to: dimethyl silicone oils, methylphenyl silicone oils, α-methylstyrene modified silicone oils, chlorophenyl silicone oils, and fluorine modified silicone oils.

Specific exemplary examples of the hydrophobizing methods using a silicone oil include, but are not limited to, the following methods: (1) a silica treated with a silane compound and a silicone oil are directly mixed using a mixer such as HENSCHEL MIXER; (2) a silicone oil is sprayed to a silica; and (3) a particulate silica is mixed with a solvent in which a silicone oil is dissolved or dispersed, and then the solvent is removed. Among these methods, the spraying method is preferably used because of producing a relatively small amount of aggregates of the particulate inorganic material.

The amount of the silicone oil treated with 100 parts by weight of the silica is preferably, in one embodiment, 1 to 40 parts by weight, and more preferably from 3 to 35 parts by weight.

Other than the wet granulation method, toner particles can be prepared, one another embodiment, by kneading toner components (such as a colorant, a release agent, a charge controlling agent, and a magnetic material) using a known kneader (such as a two-roll kneader, a double-axis extruder, and a single axis extruder) to prepare a kneaded mixture, and then pulverizing the kneaded mixture with a known pulverizer (such as a mechanical pulverizer and an airflow pulverizer), followed by classification. The method for preparing toner particles is limited to the aforementioned methods.

Image Forming Method and Image Forming Apparatus

Next, an image forming method and image forming apparatus of the present invention will be explained in detail.

Figure 1:
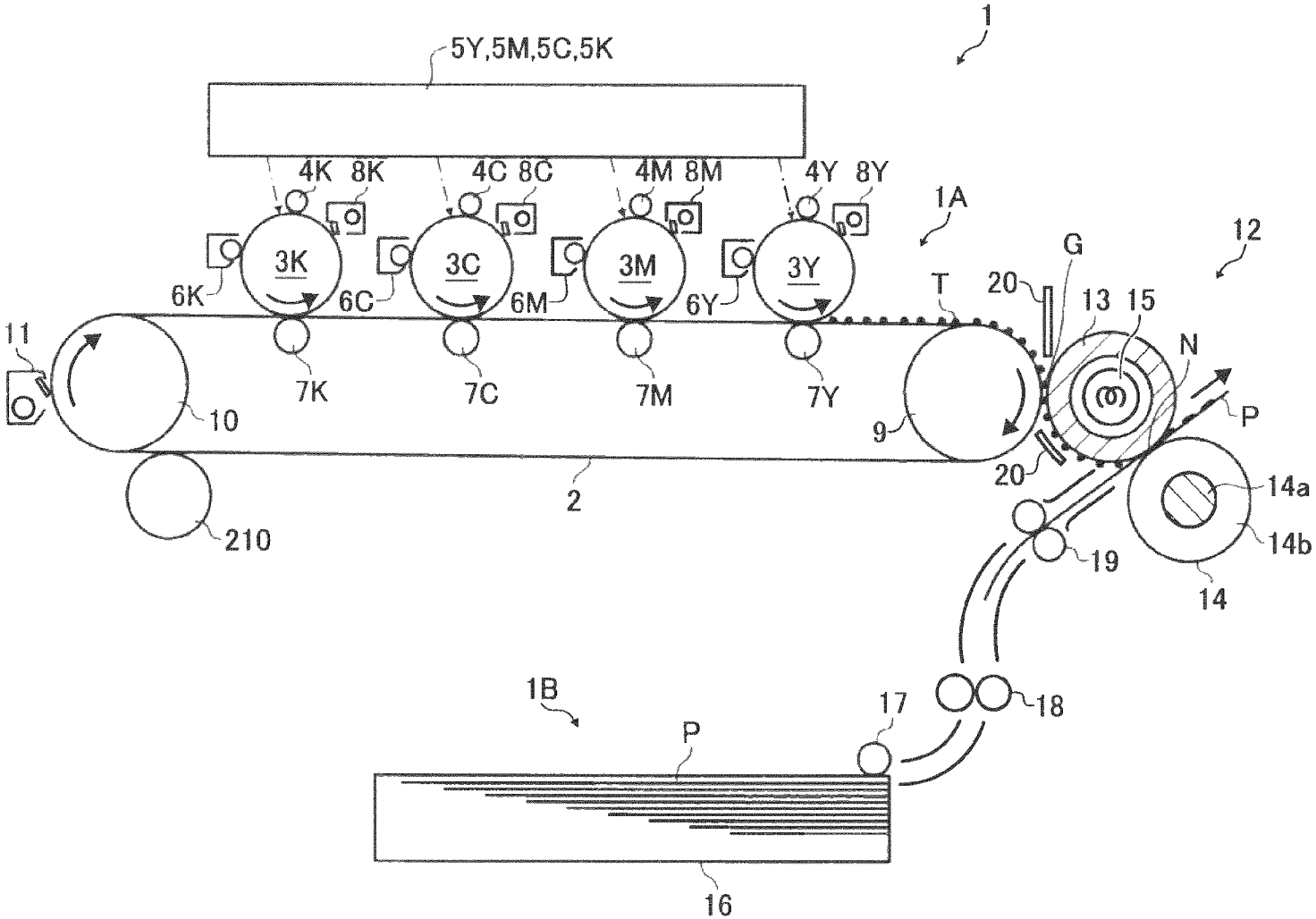
FIG. 1 is a schematic view illustrating an embodiment of the image forming apparatus of the present invention.

FIG. 1 is a schematic view illustrating an embodiment of the image forming apparatus of the present invention.

A tandem color copier 1, according to one embodiment, includes an image forming part 1A arranged in the center of the copier, a paper feeding part 1B arranged below the image forming part 1A, and an image reading part (not shown) arranged above the image forming part 1A. In an alternative embodiment, the paper feeding part is arranged above the image forming part 1A.

According to one embodiment, the image forming part 1A includes an intermediate transfer belt 2 serving as an intermediate transfer member having a transfer surface stretching in the horizontal direction, and image forming units each configured to form an image of a complementary color of a separated color. In one embodiment, photoreceptors 3Y, 3M, 3C, and 3K each serving as an image bearing member configured to bear a complementary-colored toner image (i.e., yellow, magenta, cyan, and black) are arranged along the transfer surface of the intermediate transfer belt 2.

The photoreceptors 3Y, 3M, 3C, and 3K each rotate in the same direction (i.e., counterclockwise direction). Alternatively, the photoreceptors 3Y, 3M, 3C and 3K rotate in the clockwise direction. Hereinafter, symbols Y, M, C, and K, which represent each of the colors, are omitted from the reference number. Around the photoreceptor 3, a charging device 4, a writing device 5 serving as an optical writing means, a developing device 6, a primary transfer device 7, and a cleaning device 8, each are arranged to perform an image forming process while the photoreceptor 3 rotates. Each of the developing devices 6Y, 6M, 6C, and 6K includes each of the color toners, respectively.

According to one embodiment, the intermediate transfer belt 2 is tightly stretched with a driving roller 9 and a driven roller 10 and moves in the same direction as the photoreceptors 3Y, 3M, 3C, and 3K at the facing point thereof. A cleaning device 11 configured to clean the surface of the intermediate transfer belt 2 is arranged so as to face the driven roller 10.

According to one embodiment, the surface of the photoreceptor 3Y is charged by the charging device 4Y, and then an electrostatic latent image is formed thereon according to image information from the image reading part. The electrostatic latent image is developed with the yellow toner contained in the developing device 6Y to form a yellow toner image. The yellow toner image is primary-transferred onto the intermediate transfer belt 2 by the primary transfer device 7Y to which a bias is applied. Similarly, a magenta toner image, a cyan toner image, and a black toner image are formed on the photoreceptors 3M, 3C, and 3K, respectively, and transferred onto the intermediate transfer belt 2 one by one to form an overlaid toner image.

Toner particles remaining on the photoreceptor 3 are removed, in one embodiment, by the cleaning device 8. The potential of the photoreceptor 3 is initialized by a discharging lamp (not shown) to prepare for a next image forming operation.

According to one embodiment, a fixing device 12 is arranged near the driving roller 9. The fixing device 12 includes a transfer-fixing roller 13 serving as a transfer-fixing member configured to transfer an unfixed toner image from the intermediate transfer belt 2, and a pressing roller 14 serving as a pressing member or a facing member configured to form a nip N between the transfer-fixing roller 13. In one embodiment, the transfer-fixing roller 13 is formed of a metal pipe such as an aluminum pipe, and the surface thereof is coated with a release layer. The transfer-fixing roller 13 internally includes a halogen heater 15 configured to heat a toner image on the transfer-fixing roller 13. The pressing roller 14 includes a cored bar 14*a* and an elastic layer 14*b* formed of a rubber, etc.

The paper feeding part 1B includes a paper feeding tray 16 configured to contain a paper P serving as a recording medium, a paper feeding roller 17 configured to separate and feed the uppermost sheet of the paper P contained in the paper feeding tray 16, a pair of transport rollers 18 configured to transport a sheet of the paper P, and a pair of registration rollers 19 configured to stop the sheet of the paper P at once so as to adjust a displacement thereof, and timely feed the sheet of the paper P to the nip N so that a predetermined position thereof meets the tip of the toner image on the transfer-fixing roller 13.

A toner image T, primary-transferred from the photoreceptors 3Y, 3M, 3C, and 3K onto the intermediate transfer belt 2, is then secondary-transferred onto the transfer-fixing roller 13 due to an electrostatic force when a bias is applied to the driving roller 9 from a bias applying means (not shown).

A gap G formed between the intermediate transfer belt 2 and the transfer-fixing roller 13 has a distance smaller than the thickness of the toner image T. Namely, the intermediate transfer belt 2 contacts the transfer-fixing roller 13 with the toner image T therebetween, and therefore high quality images are produced. In this embodiment, non-image portions of the intermediate transfer belt 2 do not contact the transfer-fixing roller 13.

Since the intermediate transfer belt 2 contacts the transfer-fixing roller 13 with the toner image T therebetween, the intermediate transfer belt 2 is prevented from being heated by the transfer-fixing roller 13. As a result, the lives of the photoreceptors 3Y, 3M, 3C, and 3K can be lengthened. In another embodiment, the gap G may have a distance larger than the thickness of the toner image T. In this embodiment, the intermediate transfer belt 2 is effectively prevented from being heated, resulting in longer lives of the photoreceptors 3Y, 3M, 3C, and 3K.

In another embodiment, the copier 1 may include a temperature rising means serving as a heating means and a heater serving as a heating means for heating a recording medium (not shown).

Since the intermediate transfer belt 2 does not draw heat, the copier 1 improves energy conservation. Although the transfer process is performed at stable thermal temperatures, there is a concern that the image quality deteriorates because the transfer distance of the toner image T is too long. It is preferable that the optimum transfer distance is determined from experimental results.

In one embodiment, a heat insulating plate 20 serving as a heat rejection member or a heat transfer inhibit member configured to prevent heat radiation and heat transfer from the transfer-fixing roller 13 to the intermediate transfer belt 2 is arranged therebetween. The heat insulating plate 20 has an opening so as to prevent heat radiation as much as possible while not inhibiting the secondary transfer of a toner image from the intermediate transfer belt 2 to the transfer-fixing roller 13. The heat insulating plate 20 may be arranged on both the fixing device side or the copier side.

As the heat transfer inhibit member, in one embodiment, a plate member having a metallic luster and a low emissivity is preferably used. In particular, a pair of metallic sheets sandwiching a micro air gap or a heat insulating member has good properties as the heat transfer inhibit member. When a thin plate having a micro heat pipe structure for use in cooling the CPU of a notebook computer is used in one embodiment, the heat transfer inhibit member can be kept cool and prevented from transferring heat.

According to one embodiment, a cooling roller 210 serving as a cooling member configured to draw heat from the intermediate transfer belt 2 is arranged so as to face the intermediate transfer belt 2 at a portion between a transfer part facing the transfer fixing belt 13 and another transfer part facing the photoreceptor 3K, which is arranged on the most upstream side among the photoreceptors. The cooling roller 210 is formed of a material having a high thermal conductivity, and rotates in contact with the intermediate transfer belt 2. Although the copier 1 includes both the heat insulating plate 20 and the cooling roller 210, the image forming apparatus of the present invention, in one embodiment, may include at least one of them. In the copier 1, the temperature of the intermediate transfer member can be decreased and the thermal deterioration thereof can be prevented. In addition, the transfer-fixing member can be freely designed.

The toner image T, transferred from the intermediate transfer belt 2 to the transfer-fixing roller 13, is heated alone on the transfer-fixing roller 13 before transferred onto the paper P at the nip N. Since the toner image T is previously heated alone for a sufficient time, the heating temperature can be decreased compared to a conventional method in which the toner image T and the paper P are simultaneously heated. As a result of the experiments conducted by the present inventors, high quality images can be produced even if the transfer-fixing roller 13 has low temperatures from 110 to 120° C.

Because the paper draws heat to some extent in a conventional color image forming apparatus, 1.5 times of heat is applied to the toner image T compared to a monochrome image forming apparatus, to obtain images having satisfactory glossiness. Therefore, if the paper is heated too much, adhesiveness between the toner and the paper is enhanced too much.

In one embodiment of the present invention, a preset temperature of the transfer-fixing roller 13 can be reduced because the need to consider the influence of paper P to obtain images having satisfactory glossiness is eliminated. Since the paper P is only heated at the nip N, the paper P is not heated too much and adhesiveness between the toner and the paper is not enhanced too much.

In one embodiment of the present invention, a toner can be fixed at low temperatures, a warm-up time can be shortened, and consumed energy can be reduced. In addition, heat transfer to the intermediate transfer member can be prevented, resulting in improving durability. Moreover, the temperature of the intermediate transfer member can be decreased, resulting in preventing thermal deterioration of the intermediate transfer member.

In one embodiment, the fixing device 12 for use in the present invention has a function of transferring an unfixed toner. On the other hand, a conventional fixing device only has a function of heating and pressing a paper having an unfixed image thereon. Therefore, the fixing device 12 is referred to as a "transfer-fixing device."

Quantitative Determination of Particulate Resin

According to one embodiment, the amount of a particulate resin included in a toner is determined by a pyrolysis gas chromatograph mass spectrometer QP5000 (from Shimadzu Corporation). The measurement conditions, in one embodiment, are as follows:

Pyrolysis temperature: 600° C.

Column: Ultra ALLOY-FFAP (length: 60 m, inner diameter: 0.25 mm, film: 0.25 μm)

Column temperature: 40° C. for 2 min and heated to 180° C. at a temperature rising rate of 10° C./min Pressure of carrier gas: 111.1 kPa for 2 min and increased to 120 kPa at a pressure rising rate of 2 kPa/min Detector voltage: 1.20 V Ionizing method: EI method (70 eV)

In one embodiment, after preparing calibration curves of the monomer ions, quantitative calculation is performed using a data processing device CLASS-5000 (Wiley 229 Lib.) from Shimadzu Corporation.

Having disclosed exemplary embodiments of the present invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Toner Binder Resin

The following components are fed in a reaction vessel equipped with a condenser, a stirrer and a nitrogen feed pipe.

| | |
|---|---|
| Ethylene oxide (2 mole) adduct of bisphenol A | 724 parts |
| Isophthalic acid | 276 parts |
| Dibutyl tin oxide | 2 parts |

The mixture is reacted for 10 hours at 270° C. under normal pressure. Then the reaction is further continued for 5 hours under a reduced pressure of 10 to 15 mmHg, and then the mixture is cooled to 160° C. Further, 32 parts of phthalic anhydride is added thereto. The mixture is reacted for 2 hours, and then cooled to 80° C. Then the reaction product is reacted with 188 parts of isophorone diisocyanate for 2 hours in ethyl acetate. Thus, a prepolymer (1) having an isocyanate group is prepared.

Next, 267 parts of the prepolymer (1) is reacted with 14 parts of isophorone diamine for 2 hours at 50° C. Thus, a urea-modified polyester resin (1) having a peak molecular weight of 7,800 is prepared. The urea-modified polyester resin (1) has a Tg of 68° C.

Next, the following components are fed in a reaction vessel equipped with a condenser, a stirrer and a nitrogen feed pipe.

| | |
|---|---|
| Ethylene oxide (2 mole) adduct of bisphenol A | 724 parts |
| Terephthalic acid | 276 parts |

The mixture is reacted for 10 hours at 250° C. under normal pressure. Then the reaction is further continued for 5 hours under a reduced pressure of 10 to 15 mmHg. Thus, an unmodified polyester resin (a) having a peak molecular weight of 4,500 is prepared.

Next, 100 parts of the urea-modified polyester resin (1) and 900 parts of the unmodified polyester resin (a) are dissolved in 2,000 parts of a mixed solvent of acetic acid and MEK (acetic acid/MEK=1/1). Thus, an acetic acid/MEK solution of a toner binder resin (1) is prepared. A part of the solution is dried under reduced pressure to isolate the toner binder resin (1) The toner binder resin (1) has a Tg of 60° C.

Preparation of Particulate Resin

In a reaction vessel equipped with a stirrer and a thermometer, 683 parts of water, 11 parts of a sodium salt of sulfate of an ethyleneoxide adduct of methacrylic acid (ELEMINOL RS-30 from Sanyo Chemical Industries Ltd.), 100 parts of styrene, 38 parts of butyl acrylate, 138 parts of methacrylic acid, and 1 part of ammonium persulfate are contained and the mixture is agitated with the stirrer for 15 minutes at a revolution of 400 rpm. As a result, a milky emulsion is prepared. Then the emulsion is heated to 75° C. to react the monomers for 5 hours.

Further, 30 parts of a 1% aqueous solution of ammonium persulfate are added thereto, and the mixture is aged for 5 hours at 75° C. Thus, an aqueous dispersion (i.e., a particulate resin dispersion (1)) of a vinyl resin (i.e., a copolymer of styrene/methacrylic acid/sodium salt of sulfate of ethylene oxide adduct of methacrylic acid) is prepared.

A volume average particle diameter measured by the particulate resin dispersion (1) using a laser-type PARTICLE SIZE DISTRIBUTION ANALYZER LA-920 from Horiba, Ltd. is 0.14 μm. Apart of the particulate resin is isolated and dried. The resin has a glass transition temperature (Tg) of 87° C.

The procedure for preparing the particulate resin dispersion (1) is repeated except that the amount of butyl acrylate is changed to 6 parts and that of methacrylic acid is changed to 100 parts. Thus, a particulate dispersion (2) is prepared.

A volume average particle diameter measured by the particulate resin dispersion (2) using a laser-type PARTICLE SIZE DISTRIBUTION ANALYZER LA-920 from Horiba, Ltd. is 0.21 μm. Apart of the particulate resin is isolated and dried. The resin has a glass transition temperature (Tg) of 45° C.

Preparation of Toner

Next, 240 parts of the acetic acid/MEK solution of the toner binder resin (1) prepared above, 20 parts of a pentaerythritol tetrabehenate (having a melting point of 81° C. and a melt viscosity of 25 cps), and 4 parts of a copper phthalocyanine pigment are fed in a beaker, and the mixture is agitated at 60° C. using a T. K. ROBOMICS® (from Tokusyu Kika Kogyo K. K.) at a revolution speed of 10,000 rpm. Thus, a toner constituent mixture liquid (1) is prepared.

On the other hand, 706 parts of ion-exchanged water, 0.5% by weight of the particulate resin dispersion (1) on a solid basis based on total amount of the toner components, 294 parts of a 10% suspension liquid of a hydroxyapatite (SUPATITE®10 manufactured by Nippon Chemical Industrial Co., Ltd.), and 0.5 parts of sodium dodecylbenzene sulfonate are fed in another beaker and mixed. Thus, a water phase (1) is prepared.

The water phase (1) is heated to 60° C., and then the toner constituent mixture liquid (1) is added thereto while the mixture is agitated using a T.K. ROBOMICS® at a revolution of 14,000 rpm. The mixture is further agitated for 10 minutes. Thus, a dispersion (1) is prepared.

The dispersion (1) is fed to a conical flask equipped with a stirrer and a thermometer, and heated to 40° C. so as to completely remove the solvent therefrom. The dispersion (1) is subjected to filtration, washing, drying, and classification using wind power. Thus, mother toner particles (1) are prepared.

Next, 100 parts of the mother toner particles (1) are mixed with 1.5 parts of a hydrophobized silica having a primary particle diameter of 10 nm, 1.0 parts of a titanium oxide having a primary particle diameter of 20 nm, and 1.0 parts of a HMDS (hexamethyldisilazane) treated silica having a primary particle diameter of 100 nm using a HENSCHEL MIXER. Thus, a toner (a) is prepared.

The procedure for preparing the toner (a) is repeated except that the revolution number in the emulsification, the amount of the hydroxyapatite, the type of the particulate resin, and the amount of the particulate resin are changed to those described in Table 1. Thus, toners (b) to (r) are prepared.

The toners (g), (h), and (i) are prepared by subjecting the toner (c) to a wind power classification using ELBOW-JET AIR CLASSIFIER to control the particle diameter distribution.

The properties of the toners (a) to (r) are shown in Table 2.

TABLE 1

| Toner | Revolution Number in Emulsification (rpm) | Amount of Hydroxyapatite (parts by weight) | Type of Particulate Resin | Amount of Particulate Resin (% by weight based on toner) | Example |
|---|---|---|---|---|---|
| a | 14,000 | 294 | 1 | 0.5 | Comp. Ex. 1 |
| b | 12,000 | 294 | 1 | 0.5 | Ex. 1 |
| c | 10,000 | 294 | 1 | 0.5 | Ex. 2 |
| d | 8,000 | 294 | 1 | 0.5 | Ex. 3 |
| e | 7,000 | 294 | 1 | 0.5 | Comp. Ex. 2 |
| f | 6,000 | 294 | 1 | 0.5 | Comp. Ex. 3 |
| g | 10,000 | 294 | 1 | 0.5 | Ex. 4 |
| h | 10,000 | 294 | 1 | 0.5 | Ex. 5 |
| i | 10,000 | 294 | 1 | 0.5 | Ex. 6 |
| j | 10,000 | 200 | 1 | 0.5 | Ex. 7 |
| k | 10,000 | 100 | 1 | 0.5 | Ex. 8 |
| l | 10,000 | 0 | 1 | 0.5 | Ex. 9 |
| m | 10,000 | 294 | — | 0 | Ex. 10 |
| n | 10,000 | 294 | 1 | 0.6 | Ex. 11 |
| o | 10,000 | 294 | 1 | 1 | Ex. 12 |
| p | 10,000 | 294 | 1 | 2 | Ex. 13 |
| q | 10,000 | 294 | 1 | 3.5 | Ex. 14 |
| r | 10,000 | 294 | 2 | 2 | Ex. 15 |

TABLE 2

| Toner | D4 (μm) | D4/D1 | Average Circularity | Quantitative Amount of Particulate Resin (% by weight) | Example |
|---|---|---|---|---|---|
| a | 2.2 | 1.17 | 0.94 | 0.43 | Comp. Ex. 1 |
| b | 3.1 | 1.18 | 0.93 | 0.42 | Ex. 1 |
| c | 4.3 | 1.20 | 0.94 | 0.46 | Ex. 2 |
| d | 4.9 | 1.18 | 0.92 | 0.43 | Ex. 3 |
| e | 6.2 | 1.19 | 0.92 | 0.44 | Comp. Ex. 2 |
| f | 7.5 | 1.18 | 0.91 | 0.40 | Comp. Ex. 3 |
| g | 3.9 | 1.05 | 0.94 | 0.45 | Ex. 4 |
| h | 4.0 | 1.10 | 0.94 | 0.41 | Ex. 5 |
| i | 4.2 | 1.14 | 0.94 | 0.41 | Ex. 6 |
| j | 4.2 | 1.18 | 0.95 | 0.43 | Ex. 7 |
| k | 4.1 | 1.16 | 0.97 | 0.44 | Ex. 8 |
| l | 4.3 | 1.18 | 0.99 | 0.42 | Ex. 9 |
| m | 5.8 | 1.65 | 0.94 | 0 | Ex. 10 |
| n | 4.2 | 1.19 | 0.94 | 0.58 | Ex. 11 |
| o | 4.3 | 1.18 | 0.94 | 0.98 | Ex. 12 |
| p | 4.1 | 1.17 | 0.93 | 1.81 | Ex. 13 |
| q | 4.5 | 1.18 | 0.92 | 3.25 | Ex. 14 |
| r | 4.4 | 1.17 | 0.94 | 1.75 | Ex. 15 |

Preparation of Carrier

The following components are mixed for 20 minutes using HOMOMIXER to prepare a coating liquid.

| | |
|---|---|
| Toluene | 100 parts |
| Polydimethylsiloxane resin having silanol group | 100 parts |
| γ-(2-Aminoethyl)atninopropyl trimethoxysilane | 5 parts |
| Carbon black | 5 parts |

The coating liquid is coated on 1,000 parts of a particulate magnetite having a particle diameter of 50 μm using a fluidized bed coating device. Thus, a magnetic carrier is prepared.

Preparation of Developer 9 parts of each of the toners (a) to (r) and 91 parts of the magnetic carrier are mixed using a ball mill. Thus, two-component developers are prepared.

Evaluation of Image

Each of the above-prepared developers is set in the developing device 6C illustrated in FIG. 1, and images formed on a transfer paper are evaluated.

(1) Dot Uniformity

A 1-by-1 image (i.e., an image having one-dot intervals) is produced, and visually observed with a microscope to evaluate dot reproducibility. The dot reproducibility is classified into five grades using a grade specimen. The greater the better, and the grade 3 or higher is acceptable.

(2) Transfer Hollow Defect

An image chart having an image area proportion of 20% is produced. The letter part is observed with a microscope whether hollow defect occurs or not. The level of the hollow defect is classified into five grades using a grade specimen. The greater the better, and the grade 3 or higher is acceptable.

(3) Thin Line Reproducibility

A photographic image is produced. Granularity and sharpness of the image are visually observed and evaluated by comparing with the standard offset printing image. The thin line reproducibility is classified into five grades as follows.

5: Offset-printing-like quality
4: Slightly inferior to offset-printing-like quality
3: Greatly inferior to offset-printing-like quality
2: Conventional electrophotographic-image-like quality
1: Greatly inferior to conventional electrophotographic-image-like quality The evaluation results are shown in Table 3.

TABLE 3

| Toner | Example | Dot Uniformity | Transfer Hollow Defect | Thin Line Reproducibility |
|---|---|---|---|---|
| a | Comp. Ex. 1 | 2 | 2 | 1 |
| b | Ex. 1 | 4 | 3 | 4 |
| c | Ex. 2 | 3 | 3 | 3 |
| d | Ex. 3 | 3 | 3 | 3 |
| e | Comp. Ex. 2 | 2 | 2 | 2 |
| f | Comp. Ex. 3 | 1 | 1 | 1 |
| g | Ex. 4 | 5 | 4 | 4 |
| h | Ex. 5 | 4 | 3 | 4 |
| i | Ex. 6 | 4 | 3 | 3 |
| j | Ex. 7 | 4 | 4 | 3 |
| k | Ex. 8 | 5 | 5 | 4 |
| l | Ex. 9 | 4 | 5 | 4 |
| m | Ex. 10 | 2 | 3 | 2 |
| n | Ex. 11 | 4 | 4 | 4 |
| o | Ex. 12 | 5 | 4 | 5 |
| p | Ex. 13 | 4 | 5 | 5 |
| q | Ex. 14 | 3 | 3 | 3 |
| r | Ex. 15 | 3 | 3 | 2 |

It is clear from the evaluation results that toners having a weight average particle diameter (D4) of from 3 to 5 μm produce images with good dot uniformity. In particular, the narrower particle diameter distribution a toner has, the better quality image the toner produces. However, the transfer hollow defect and thin line reproducibility of these images are acceptable, but not excellent.

Toners having an average circularity of not less than 0.95 produce images with good transfer hollow defect.

Toners having a weight average particle diameter (D4) of from 3to 5 μm (i.e., the claimed range) and including a particulate resin in an amount of from 0.5 to 3% by weight produce images with good thin line reproducibility.

Having fully disclosed the invention, it is apparent to one of ordinary skill in the art that many changes and modifications can be made thereto without departing from the spirit and scope of the invention as set forth therein.

What is claimed as new is:

1. An image forming method, comprising:

charging an image bearing member;

irradiating the image bearing member with a light beam to form an electrostatic latent image thereon;

developing the electrostatic latent image with a toner to form a toner image on the image bearing member;

primarily transferring the toner image from the image bearing member onto an intermediate transfer member;

secondarily transferring the toner image from the intermediate transfer member onto a transfer-fixing member;

heating the toner image on the transfer-fixing member; and fixing the toner image on a recording medium passing through a nip formed between the transfer-fixing member and a pressing member, wherein the toner has a weight average particle diameter (D4) of from 3 to 5 μm.

2. The image forming method according to claim 1, wherein the toner has a particle diameter distribution (D4)/(D1) of from 1.0 to 1.15, and wherein the particle diameter distribution is a ratio of the weight average particle diameter (D4) to a number average particle diameter (D1).

3. The image forming method according to claim 1, wherein the toner has an average circularity of not less than 0.95.

4. The image forming method according to claim 1, wherein the toner includes a colorant and a binder resin, and wherein the toner further includes a resin layer, having a glass transition temperature (Tg) higher than that of the binder resin, formed on the surface of the toner.

5. The image forming method according to claim 1, wherein the toner includes a colorant and a binder resin, and wherein the toner further includes a particulate resin, having a glass transition temperature (Tg) higher than that of the binder resin, adhered or fused to the surface of the toner.

6. The image forming method according to claim 4, wherein an amount of the resin layer ranges from 0.5 to 3% by weight based on total weight of the toner.

7. The image forming method according to claim 5, wherein an amount of the particulate resin ranges from 0.5 to 3% by weight based on total weight of the toner.

8. The image forming method according to claim 1, further comprising preparing the toner, wherein preparing the toner includes emulsifying or dispersing a toner constituent solution or dispersion in an aqueous medium to prepare an emulsion containing droplets, to the surface of which a particulate resin is adhered, wherein the toner constituent solution or dispersion includes a colorant and a binder resin, and wherein the aqueous medium includes the particulate resin, which has a glass transition temperature (Tg) higher than that of the binder resin.

9. The image forming method according to claim 1, wherein, when secondarily transferring the toner image from the intermediate transfer member onto a transfer-fixing member, a gap between the intermediate transfer member and the transfer-fixing member is smaller than a thickness of the toner image.

* * * * *